US010031466B2

(12) United States Patent
Watanabe et al.

(10) Patent No.: US 10,031,466 B2
(45) Date of Patent: Jul. 24, 2018

(54) CLEANING BLADE, IMAGE FORMING APPARATUS, AND PROCESS CARTRIDGE

(71) Applicants: Kazuhiko Watanabe, Tokyo (JP); Takaaki Tawada, Kanagawa (JP); Hisashi Kikuchi, Kanagawa (JP); Eisuke Shimizu, Kanagawa (JP); Yuu Sakakibara, Kanagawa (JP)

(72) Inventors: Kazuhiko Watanabe, Tokyo (JP); Takaaki Tawada, Kanagawa (JP); Hisashi Kikuchi, Kanagawa (JP); Eisuke Shimizu, Kanagawa (JP); Yuu Sakakibara, Kanagawa (JP)

(73) Assignee: RICOH COMPANY, LIMITED, Tokyo (JP)

( * ) Notice: Subject to any disclaimer, the term of this patent is extended or adjusted under 35 U.S.C. 154(b) by 0 days.

(21) Appl. No.: 15/324,513

(22) PCT Filed: Jul. 31, 2015

(86) PCT No.: PCT/JP2015/003867
§ 371 (c)(1),
(2) Date: Jan. 6, 2017

(87) PCT Pub. No.: WO2016/017184
PCT Pub. Date: Feb. 4, 2016

(65) Prior Publication Data

US 2017/0199493 A1 Jul. 13, 2017

(30) Foreign Application Priority Data

Jul. 31, 2014 (JP) ..... 2014-156878
Oct. 22, 2014 (JP) ..... 2014-215194

(51) Int. Cl.
*G03G 21/00* (2006.01)
*G03G 21/18* (2006.01)

(52) U.S. Cl.
CPC ..... *G03G 21/0017* (2013.01); *G03G 21/1814* (2013.01)

(58) Field of Classification Search
CPC ..... G03G 21/0011; G03G 21/0017
See application file for complete search history.

(56) References Cited

U.S. PATENT DOCUMENTS 8,535,861 B2 9/2013 Haruyama et al.
9,052,631 B2 6/2015 Gohda et al.
(Continued)

FOREIGN PATENT DOCUMENTS

EA 005998 B1 8/2005
EP 2 233 979 A1 9/2010
(Continued)

OTHER PUBLICATIONS

Omori et al. (JP 2013-076970 A), Apr. 2013, JPO Computer Translation.*
Extended European Search Report dated Jul. 12, 2017 in European Patent Application No. 15828135.0.
International Search Report dated Sep. 15, 2015 in PCT/JP2015/003857 filed Jul. 31, 2015.
(Continued)

*Primary Examiner* — Erika J Villaluna
(74) *Attorney, Agent, or Firm* — Oblon, McClelland, Maier & Neustadt, L.L.P.

(57) ABSTRACT

A cleaning blade includes: a blade having plural layers formed with elastic materials having different degrees of hardness from each other, an edge line portion of the blade being brought into contact with a surface of a cleaning target performing surface movement to remove adhering matter from the surface of the cleaning target. A cleaning layer of the plural layers including the edge line portion is impregnated with a resin or is made of an elastic material having a high degree of hardness. A permanent elongation rate of the entire blade is set at 3.0% or lower.

10 Claims, 10 Drawing Sheets

(56) References Cited

U.S. PATENT DOCUMENTS

| | | | |
|---|---|---|---|
| 2010/0008707 | A1 | 1/2010 | Sako et al. |
| 2010/0247148 | A1 | 9/2010 | Haruyama et al. |
| 2010/0247188 | A1 | 9/2010 | Fukuda et al. |
| 2010/0284718 | A1 | 11/2010 | Ito |
| 2011/0229185 | A1 | 9/2011 | Okamoto et al. |
| 2011/0229188 | A1 | 9/2011 | Watanabe et al. |
| 2011/0229233 | A1 | 9/2011 | Watanabe et al. |
| 2011/0236095 | A1 | 9/2011 | Aoshima |
| 2013/0071163 | A1 | 3/2013 | Watanabe et al. |
| 2014/0119769 | A1 | 5/2014 | Kikuchi et al. |
| 2014/0161501 | A1 | 6/2014 | Watanabe et al. |
| 2014/0178103 | A1 | 6/2014 | Gohda et al. |
| 2014/0193172 | A1 | 7/2014 | Tawada et al. |
| 2014/0341629 | A1 | 11/2014 | Watanabe et al. |

FOREIGN PATENT DOCUMENTS

| | | | |
|---|---|---|---|
| EP | 2 749 964 | A1 | 7/2014 |
| JP | 2007-212780 | | 8/2007 |
| JP | 2010-139737 | | 6/2010 |
| JP | 2010-230705 | | 10/2010 |
| JP | 2010-262158 | | 11/2010 |
| JP | 2011-203303 | | 10/2011 |
| JP | 2016-076970 | | 4/2013 |
| JP | 2014-066767 | | 4/2014 |

OTHER PUBLICATIONS

Office Action dated Mar. 12, 2018 in corresponding Russian Patent Application No. 2017102678/28 (004665) (with English Translation), 14 pages.

* cited by examiner

[Fig. 1]
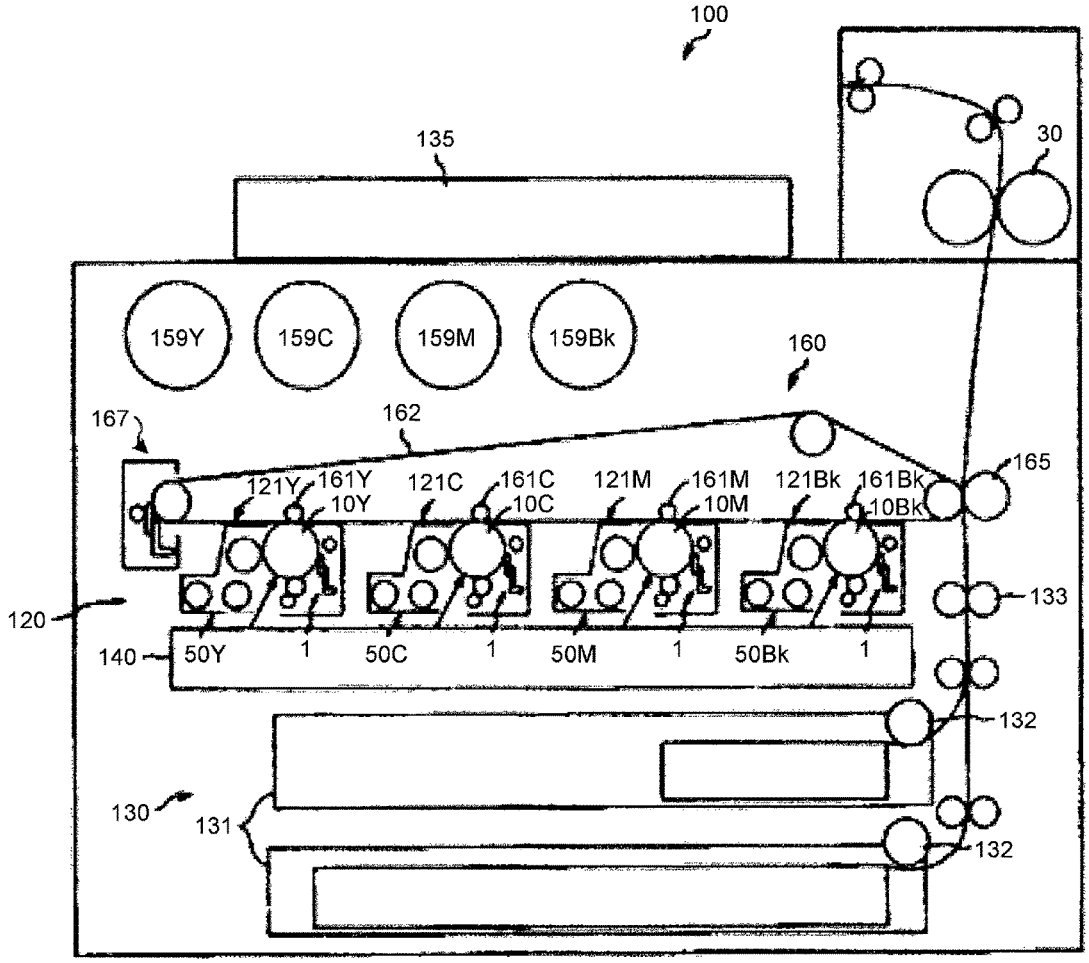
[Fig. 2]
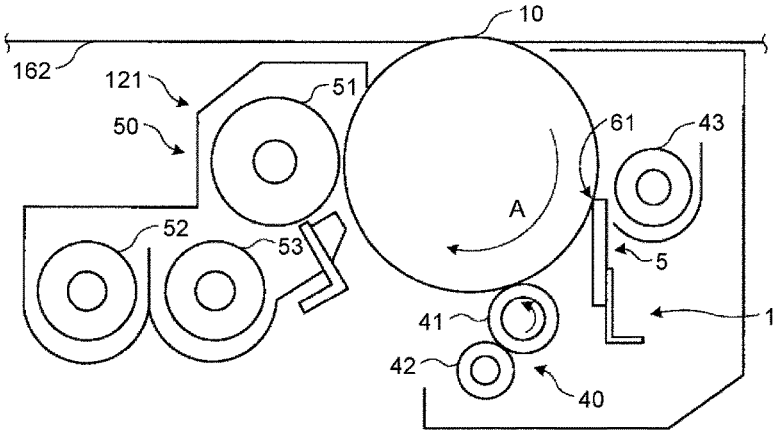

[Fig. 3A]
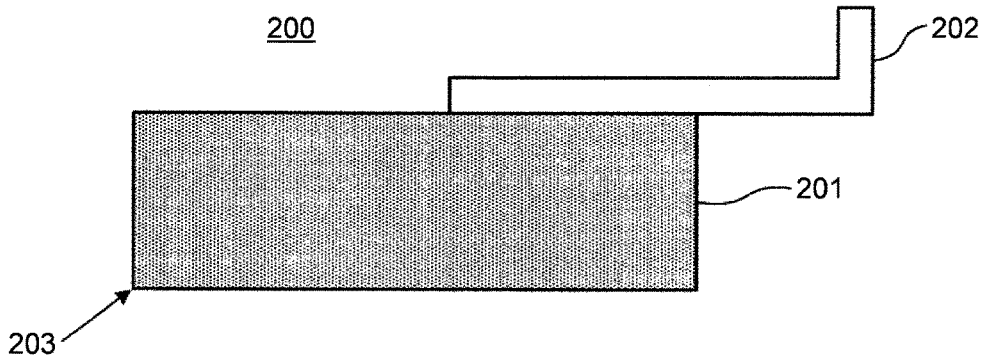
[Fig. 3B]
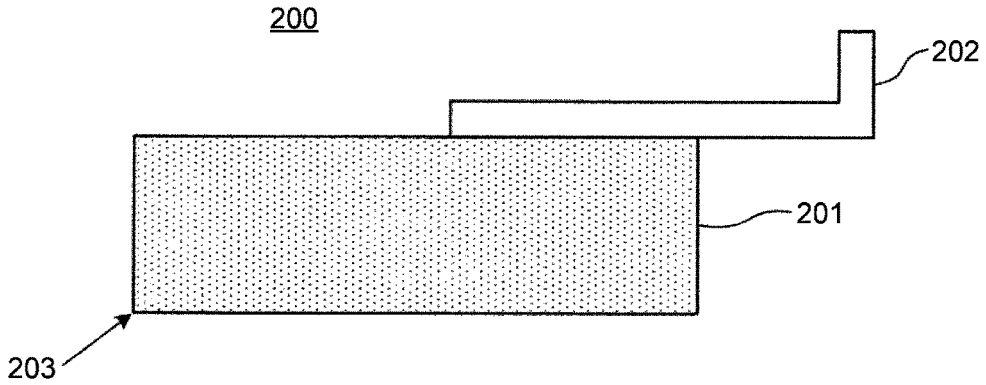
[Fig. 4]
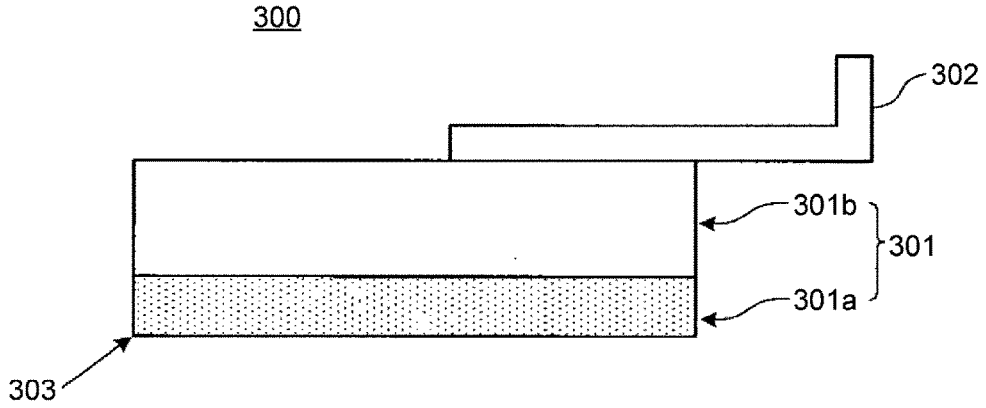

[Fig. 5A]
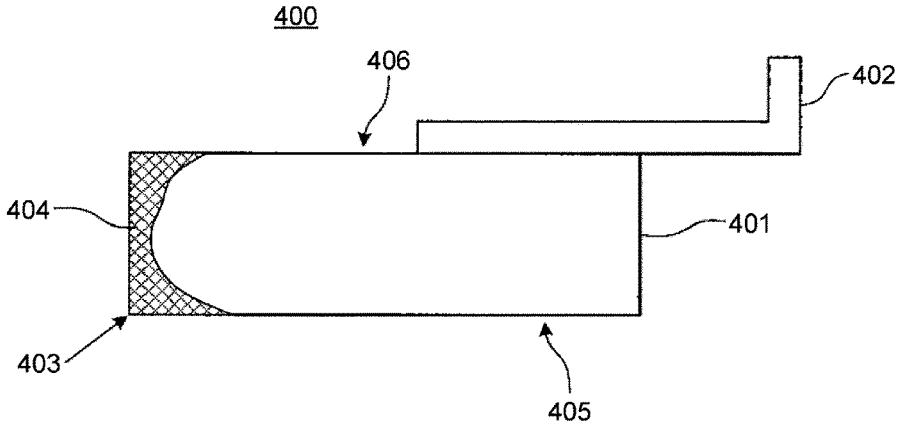
[Fig. 5B]
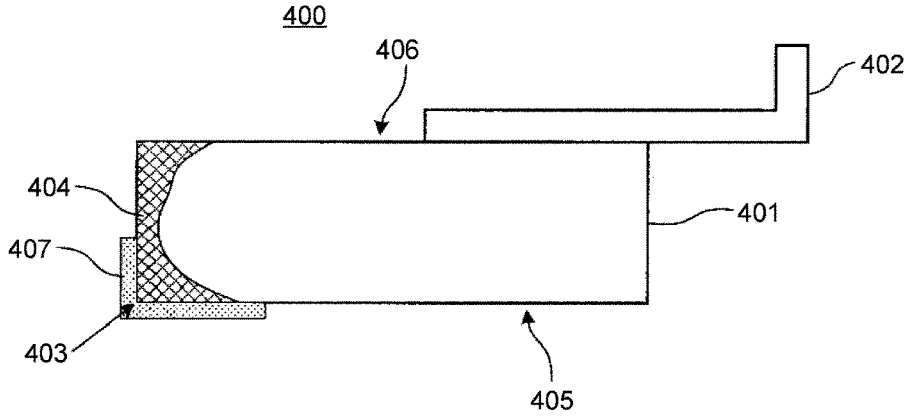
[Fig. 6]
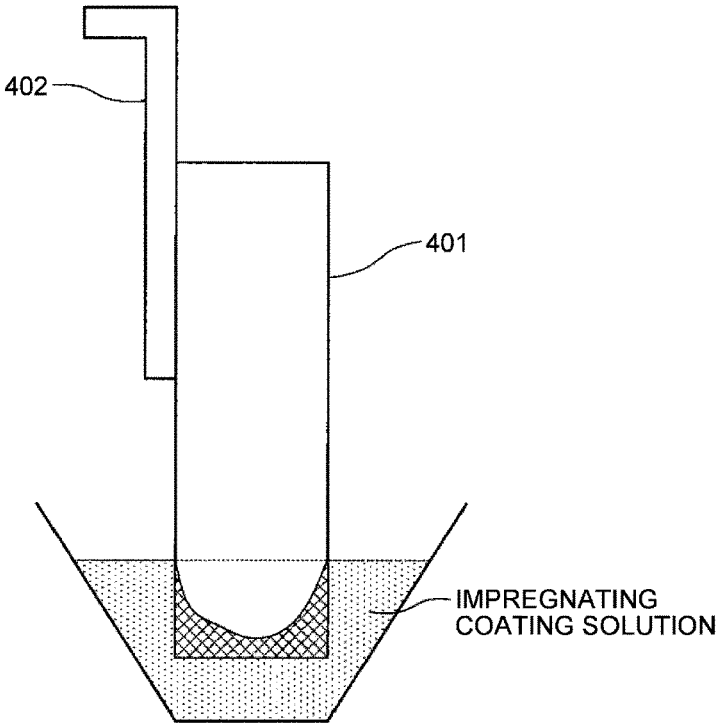

[Fig. 7]
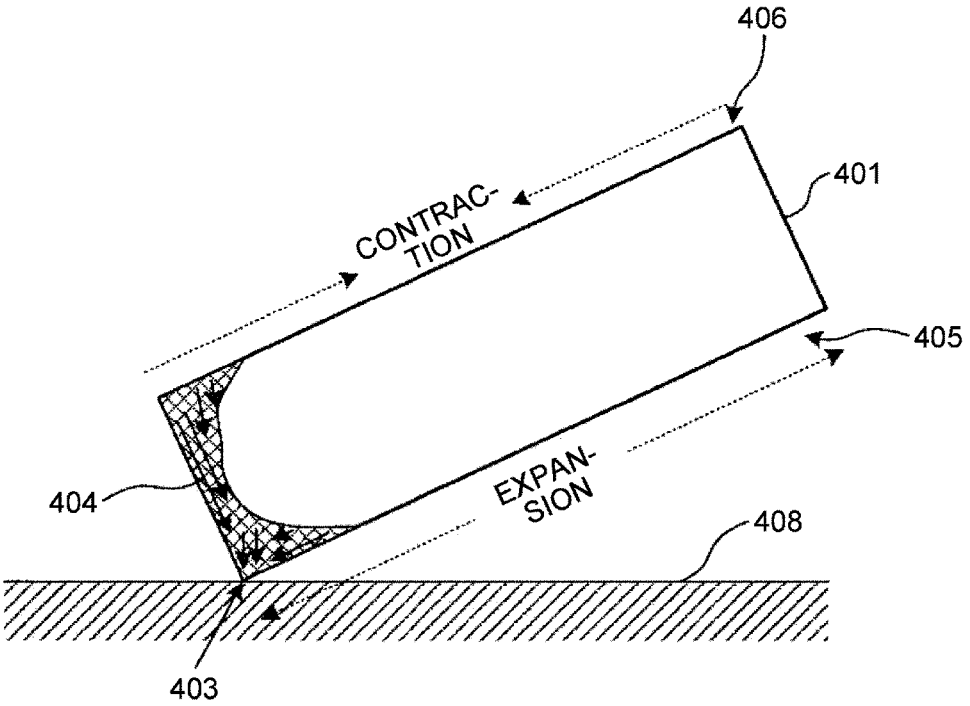
[Fig. 8]
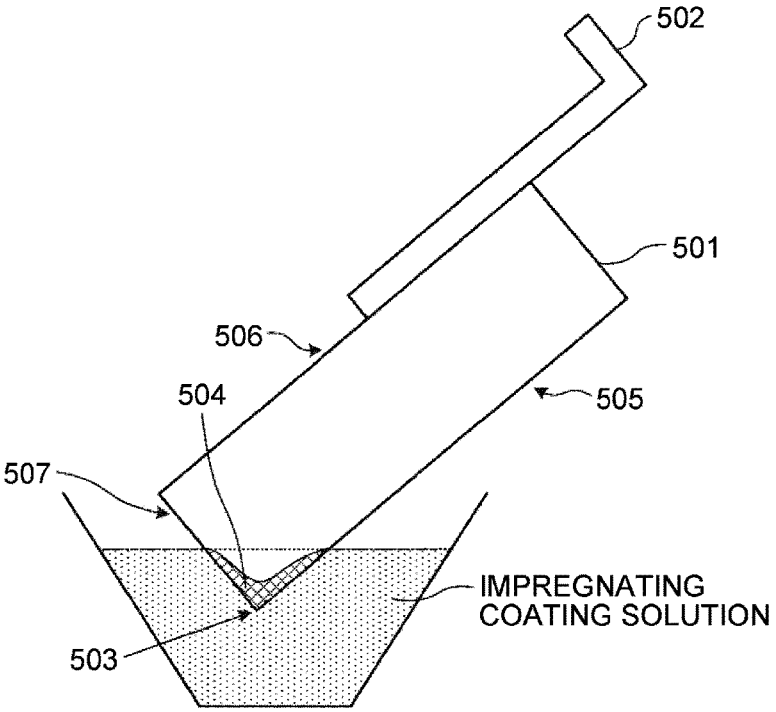

[Fig. 9]
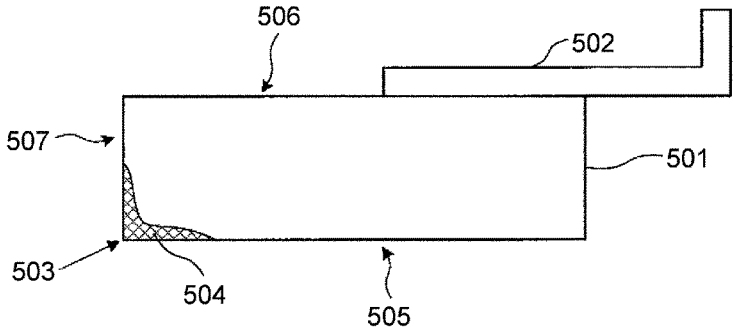
[Fig. 10]
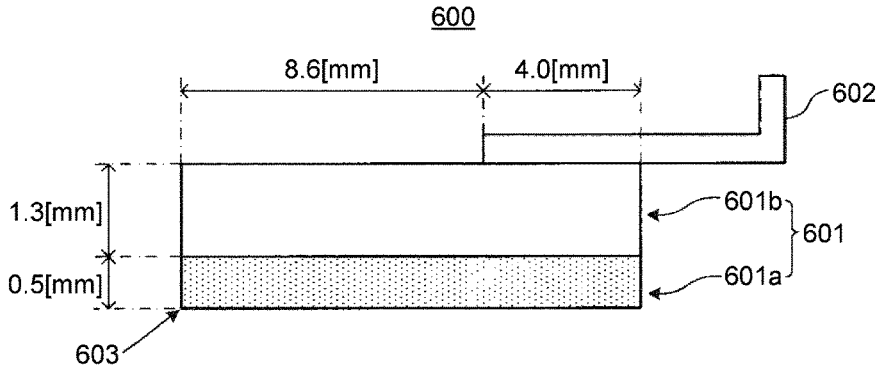
[Fig. 11]
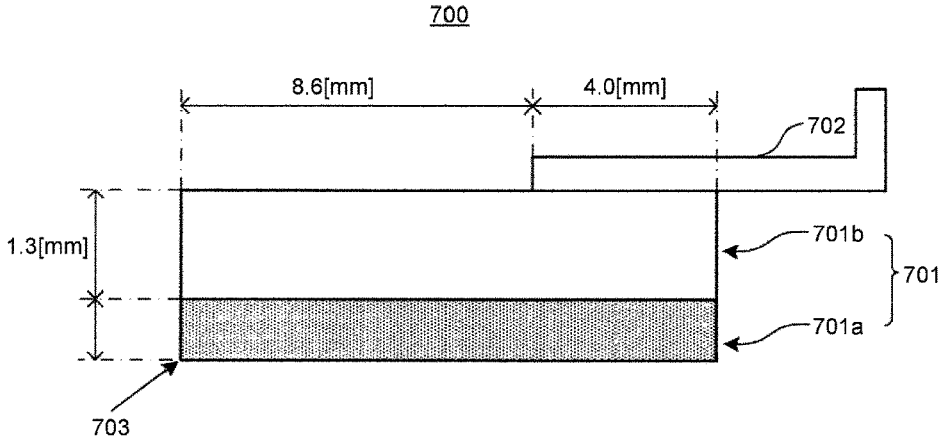
[Fig. 12]
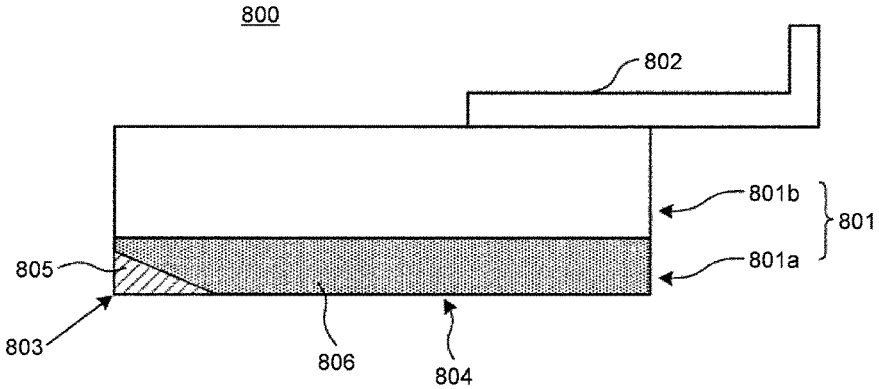

[Fig. 13A]
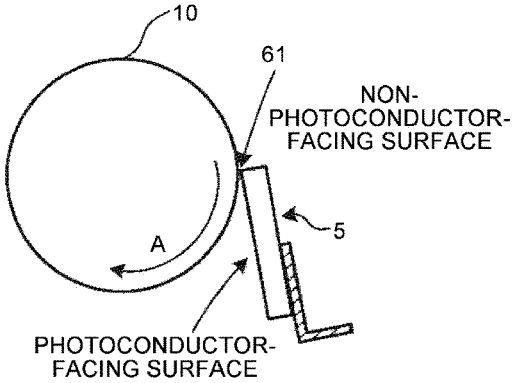
[Fig. 13B]
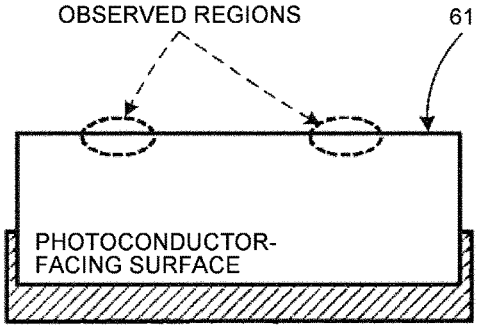
[Fig. 14]
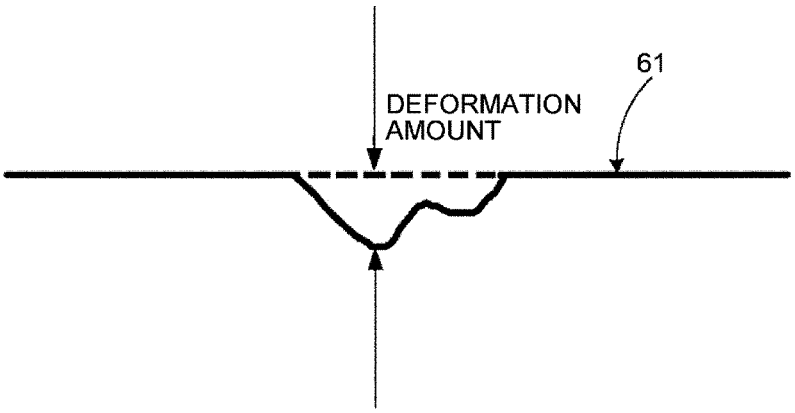
[Fig. 15]
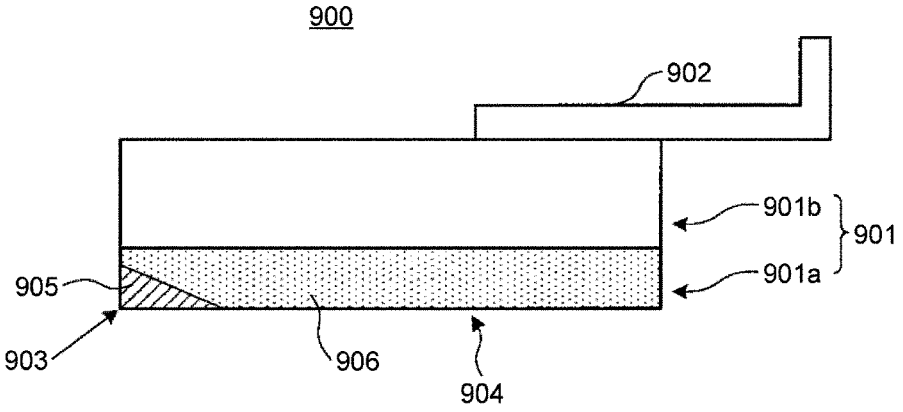

[Fig. 16]
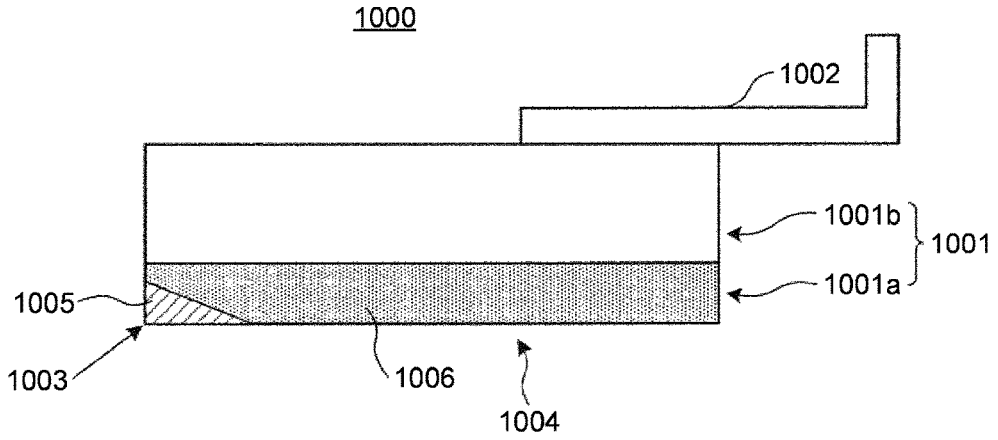
[Fig. 17]
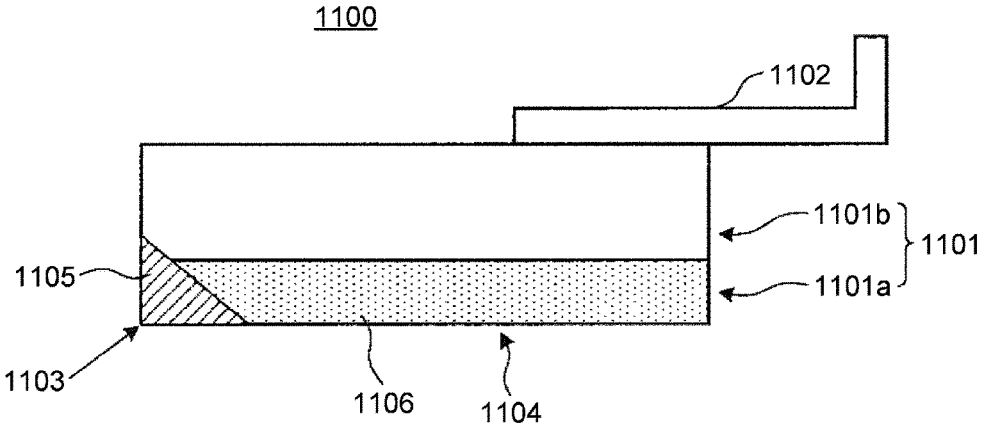
[Fig. 18]
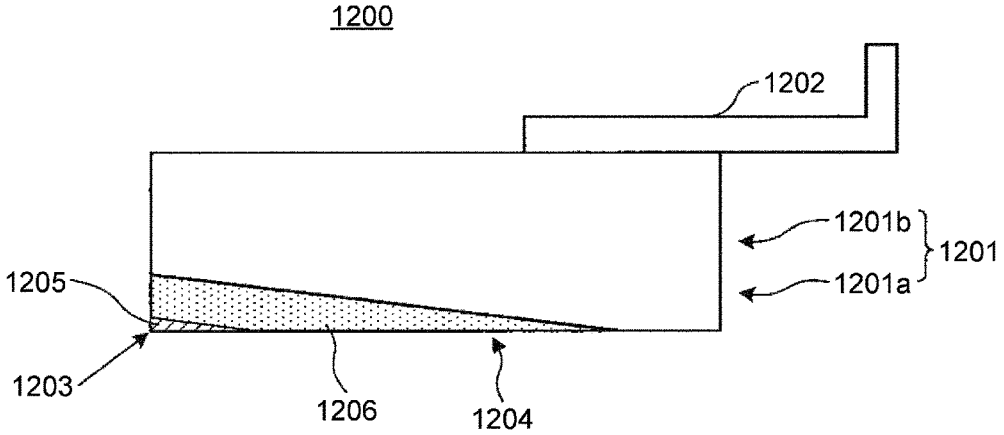

[Fig. 19]
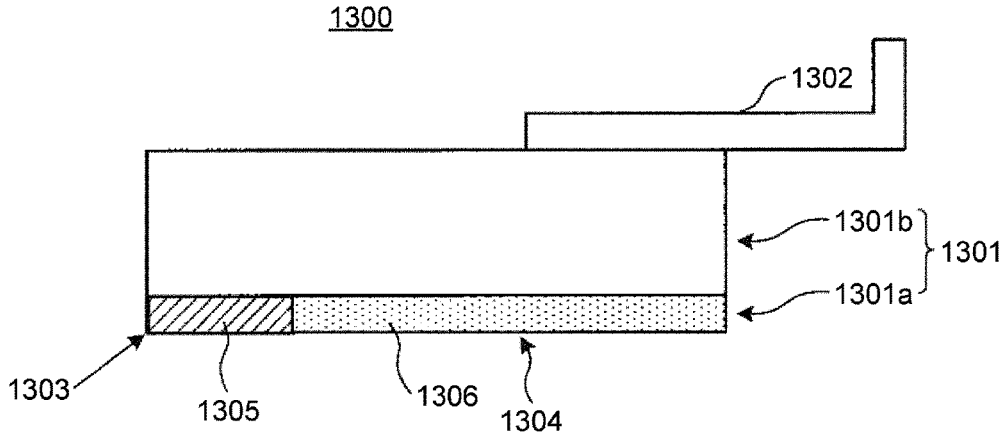
[Fig. 20]
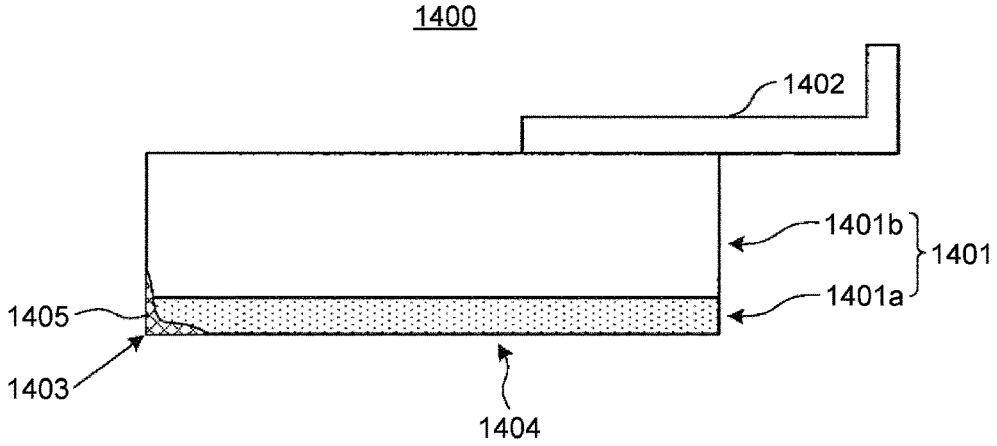
[Fig. 21]
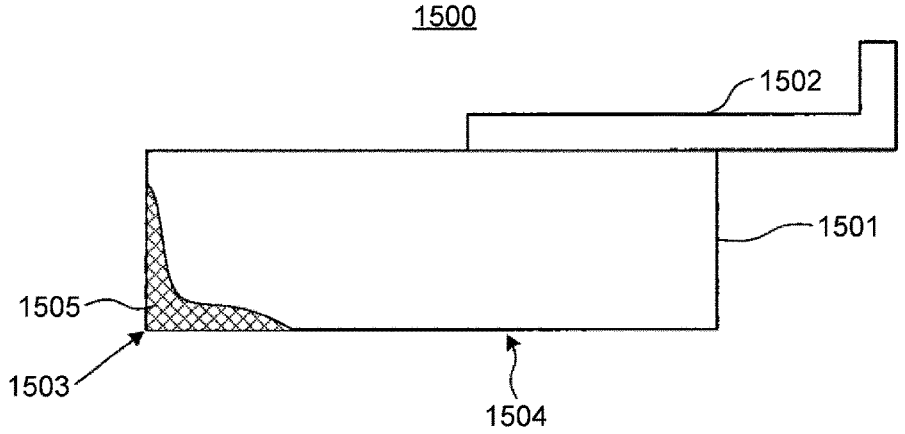

[Fig. 22]
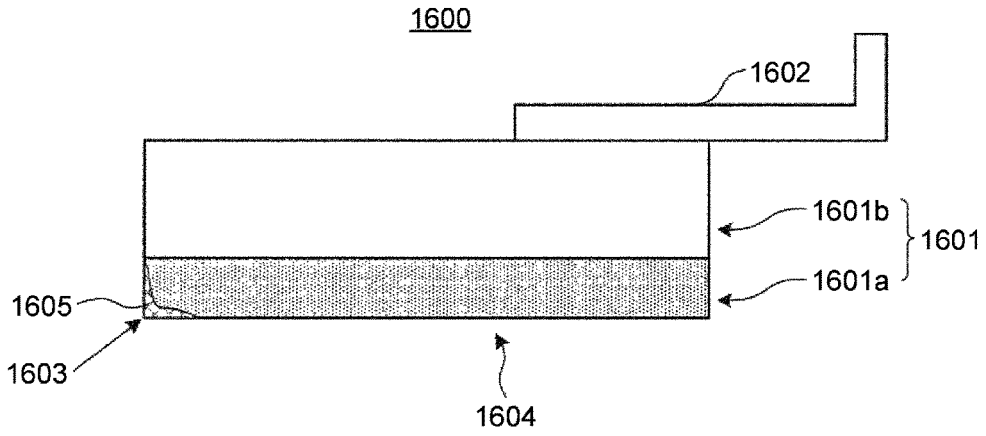
[Fig. 23]
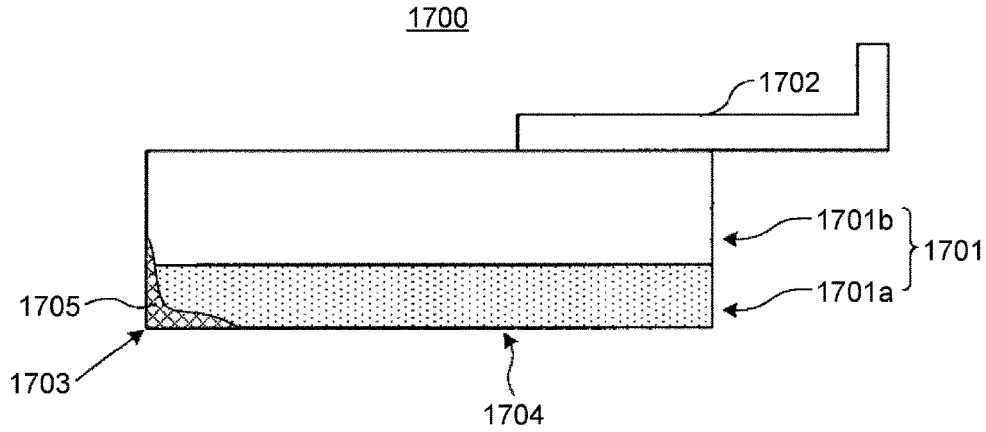
[Fig. 24]
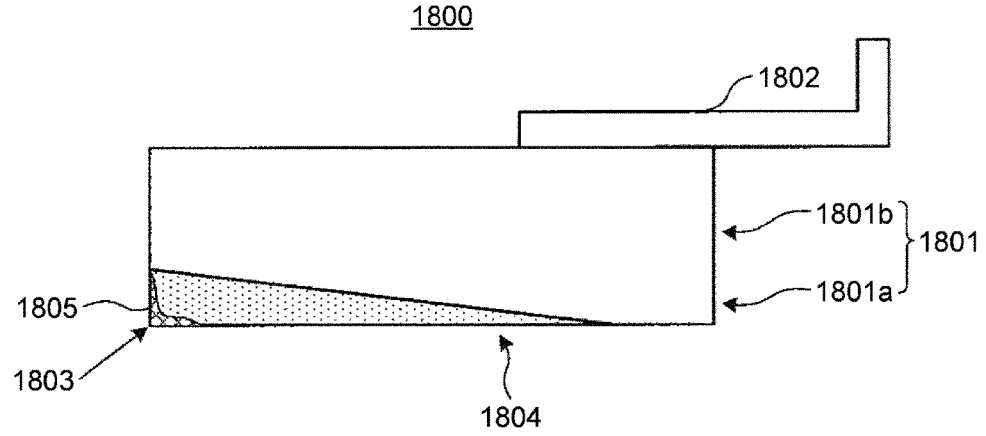

[Fig. 25]
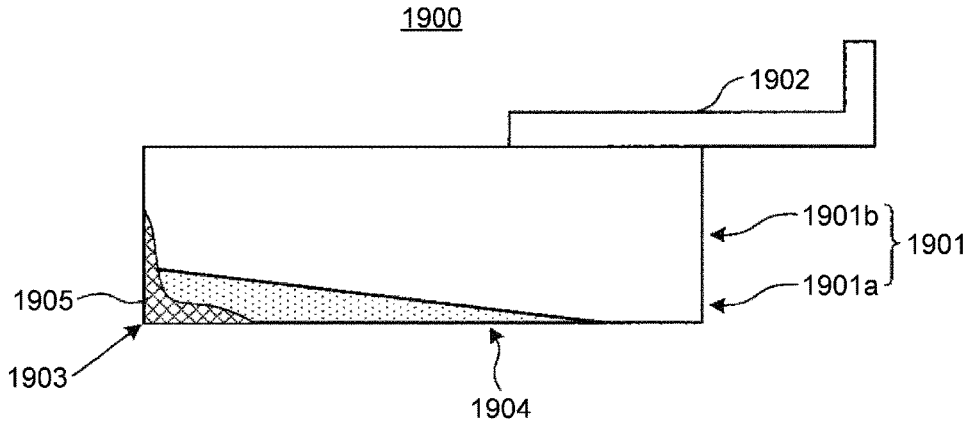
[Fig. 26]
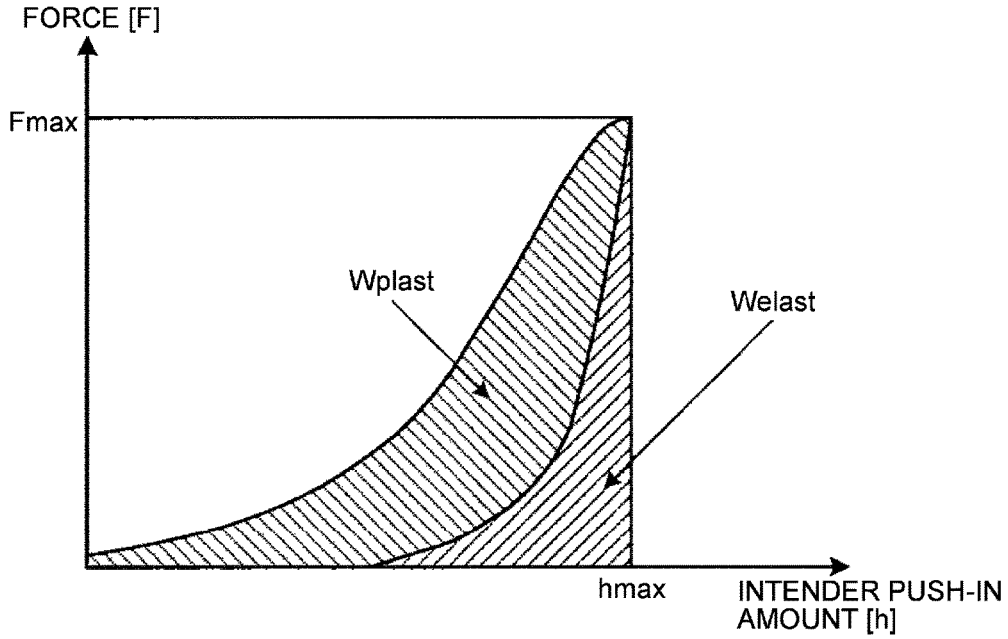

CLEANING BLADE, IMAGE FORMING APPARATUS, AND PROCESS CARTRIDGE

TECHNICAL FIELD

The present invention relates to a cleaning blade, an electrophotographic image forming apparatus using the cleaning blade, and a process cartridge detachably mounted in the image forming apparatus.

BACKGROUND ART

In a conventional electrophotographic image forming apparatus, after a toner image is transferred onto a transfer paper sheet or an intermediate transfer member, unnecessary transfer residual toner adhering to the surface of an image bearer as the cleaning target member, such as a photoconductor, is removed with a cleaning blade serving as a cleaning unit. A strip-shaped blade member is used as this cleaning blade, because such a blade member generally has a simple structure and shows excellent cleaning performance.

In a cleaning blade of a blade cleaning system, the blade member is supported by a supporting member that is made of a material having high rigidity such as a metal and is fixed to the main frame of a cleaning device, and the edge line portion of the blade member is pressed against the peripheral surface of an image bearer, to remove adhering matter adhering to the image bearer. Such a cleaning blade of a blade cleaning system has a simple structure, is inexpensive, and excels in adhering matter removal performance. Accordingly, such cleaning blades are widely used.

Patent Document 1 discloses a cleaning blade that includes a blade member having a double-layer stack structure formed with elastic members having different characteristics from each other. The edge line portion of the edge layer to be brought into contact with an image bearer as the cleaning target member is impregnated with a resin, and the surface of the impregnated edge line portion is further coated with a surface layer having a relatively high degree of hardness, so that the hardness of the edge line portion is increased.

In the cleaning blade disclosed in Patent Document 1, the hardness of the edge line portion is increased with the impregnated portion and the surface layer. Accordingly, deformation at the edge line portion becomes smaller, and an increase in the contact area can be prevented. Thus, the contact pressure can be set at a high value, and cleaning performance can be improved.

The inventors observed the contact pressure that was applied to an image bearer by a blade member over a long period of time. As a result, the inventors discovered that the blade member was permanently deformed into a curved shape, or permanent deformation occurred. The contact state varied from the initial contact state, the contact pressure became lower, and there was a possibility of defective cleaning. Even in a case where a blade member having a double-layer stack structure formed with an edge layer having a high degree of hardness and a backup layer having a low degree of hardness was used, the edge line portion was subjected to an impregnation treatment, and the impregnated portion was further coated with a surface layer, the initial excellent cleaning performance was not fully maintained depending on a combination of permanent elongation rates of the edge layer, the backup layer, and the edge line portion.

SUMMARY OF INVENTION

Technical Problem

In view of the above, there is a need to provide a cleaning blade, an image forming apparatus and a process cartridge that have a structure including a blade member having a stack structure formed with layers, and can improve its cleaning performance while preventing permanent deformation of the blade member over time.

Solution to Problem

A cleaning blade includes: a blade having plural layers formed with elastic materials having different degrees of hardness from each other, an edge line portion of the blade being brought into contact with a surface of a cleaning target performing surface movement to remove adhering matter from the surface of the cleaning target. A cleaning layer of the plural layers including the edge line portion is impregnated with a resin or is made of an elastic material having a high degree of hardness. A permanent elongation rate of the entire blade is set at 3.0% or lower.

Advantageous Effects of Invention

According to the present invention, an excellent effect to improve cleaning performance while reducing permanent deformation of a blade member over time can be achieved.

BRIEF DESCRIPTION OF DRAWINGS

FIG. 1 is a schematic diagram illustrating the structure of a printer according to this embodiment.

FIG. 2 is a diagram schematically illustrating an example structure of a process cartridge in the printer.

FIG. 3A is a schematic diagram for explaining a conventional cleaning blade.

FIG. 3B is a schematic diagram for explaining a conventional cleaning blade.

FIG. 4 is a schematic diagram for explaining another conventional cleaning blade.

FIG. 5A is a schematic diagrams for explaining yet another conventional cleaning blade.

FIG. 5B is a schematic diagrams for explaining yet another conventional cleaning blade.

FIG. 6 is a schematic diagram for explaining an impregnation treatment.

FIG. 7 is a schematic diagram for explaining deformation of a blade member when a cleaning blade is brought into contact with a photoconductor.

FIG. 8 is a schematic diagram for explaining another impregnation treatment.

FIG. 9 is a schematic diagram for explaining a blade member having an impregnated portion formed through the impregnation treatment illustrated in FIG. 9.

FIG. 10 is a schematic diagram for explaining a cleaning blade having a double-layer blade member.

FIG. 11 is a schematic diagram for explaining a cleaning blade having a double-layer blade member.

FIG. 12 is a schematic diagram for explaining a cleaning blade having a double-layer blade member.

FIG. 13A is a schematic diagrams for explaining observed regions in Experiment 4.

FIG. 13B is a schematic diagrams for explaining observed regions in Experiment 4.

FIG. 14 is an enlarged view of an observed region in Experiment 4.

FIG. 15 is a schematic diagram for explaining a cleaning blade having a double-layer blade member.

FIG. 16 is a schematic diagram for explaining a cleaning blade that includes a blade member formed with a first edge layer, a second edge layer, and a backup layer.

FIG. 17 is a schematic diagram for explaining a cleaning blade that includes a blade member formed with a first edge layer, a second edge layer, and a backup layer.

FIG. 18 is a schematic diagram for explaining a cleaning blade that includes a blade member formed with a first edge layer, a second edge layer, and a backup layer.

FIG. 19 is a schematic diagram for explaining a cleaning blade that includes a blade member formed with a first edge layer, a second edge layer, and a backup layer.

FIG. 20 is a schematic diagram for explaining an example of a cleaning blade.

FIG. 21 is a schematic diagram for explaining a comparative example of a cleaning blade.

FIG. 22 is a schematic diagram for explaining a first modification of a cleaning blade.

FIG. 23 is a schematic diagram for explaining a second modification of a cleaning blade.

FIG. 24 is a schematic diagram for explaining a third modification of a cleaning blade.

FIG. 25 is a schematic diagram for explaining a fourth modification of a cleaning blade.

FIG. 26 is a characteristic graph indicating the total stress Wplast generated when a Vickers indenter is pushed in, and the total stress Welast generated when a test load is removed.

DESCRIPTION OF EMBODIMENTS

The following is a description of an embodiment of an electrophotographic printer (hereinafter referred to simply as a printer) as an image forming apparatus to which the present invention is applied. First, the fundamental structure of the printer according to this embodiment is described.

FIG. 1 is a schematic diagram illustrating the structure of a printer 100 according to this embodiment. The printer 100 is designed to form full-color images, and includes an image forming unit 120, an intermediate transfer device 160, and a sheet feeding unit 130. In the description below, the subscripts Y, C, M, and Bk indicate that the components are made for yellow, cyan, magenta, and black, respectively.

In the image forming unit 120, a process cartridge 121Y for yellow toner, a process cartridge 121C for cyan toner, a process cartridge 121M for magenta toner, and a process cartridge 121Bk for black toner are provided. These process cartridges 121 (Y, C, M, and Bk) are substantially arranged in a straight horizontal line. The process cartridges 121 (Y, C, M, and Bk) are integrally and detachably mounted in the printer 100.

The intermediate transfer device 160 includes an endless intermediate transfer belt 162 supported by supporting rollers, primary transfer rollers 161 (Y, C, M, and Bk), and a secondary transfer roller 165. The intermediate transfer belt 162 extends in the moving direction of the surfaces of the respective drum-shaped photoconductors 10 (Y, C, M, and Bk) serving as latent image bearers that are provided on the respective process cartridges 121 (Y, C, M, and Bk) and performs surface movement. The intermediate transfer belt 162 performs surface movement in synchronization with movement of the surfaces of the photoconductors 10 (Y, C, M, and Bk). The respective primary transfer rollers 161 (Y, C, M, and Bk) are placed along the inner peripheral surface of the intermediate transfer belt 162, and the surface of the intermediate transfer belt 162 is weakly pressed against the surfaces of the respective photoconductors 10 (Y, C, M, and Bk) by virtue of these primary transfer rollers 161 (Y, C, M, and Bk).

The structure and operations to form toner images on the respective photoconductors 10 (Y, C, M, and Bk) and transfer the toner images onto the intermediate transfer belt 162 are substantially the same between the respective process cartridges 121 (Y, C, M, and Bk). However, the primary transfer rollers 161 (Y, C, and M) corresponding to the three color process cartridges 121 (Y, C, and M) is equipped with a swinging mechanism (not shown) that causes these three color process cartridges 121 (Y, C, and M) to swing vertically. The swinging mechanism operates such that the intermediate transfer belt 162 is not brought into contact with the photoconductors 10 (Y, C, and M) when no color images are formed. An intermediate transfer belt cleaning device 167 for removing adhering matter adhering to the intermediate transfer belt 162, such as residual toner after the secondary transfer, is placed on a portion of the intermediate transfer belt 162 located downstream of the secondary transfer roller 165 and upstream of the process cartridge 121Y in the surface moving direction.

Above the intermediate transfer device 160, toner cartridges 159 (Y, C, M, and Bk) corresponding to the respective process cartridges 121 (Y, C, M, and Bk) are aligned substantially in the horizontal direction. An exposure device 140 that forms an electrostatic latent image by irradiating the surfaces of charged photoconductors 10 (Y, C, M, and Bk) with laser light is placed below the process cartridges 121 (Y, C, M, and Bk).

The sheet feeding unit 130 is placed below the exposure device 140. The sheet feeding unit 130 includes sheet feeding cassettes 131 that house transfer paper sheets as recording media, and sheet feeding rollers 132. A transfer paper sheet is fed to the secondary transfer nip portion between the intermediate transfer belt 162 and the secondary transfer roller 165 via a pair of registration rollers 133 at a predetermined time.

A fixing device 30 is placed downstream of the secondary transfer nip portion in the transfer paper conveyance direction, and paper ejection rollers and an ejected paper housing unit 135 that houses ejected transfer paper sheets are placed downstream of the fixing device 30 in the transfer paper conveyance direction.

FIG. 2 is a diagram schematically illustrating an example structure of a process cartridge 121 in the printer 100. Since the structures of the respective process cartridges 121 (Y, C, M, and Bk) are substantially the same, the structure of operation of a process cartridge 121 will be described below while omitting the color-indicating alphabets Y, C, M, and Bk.

As shown in FIG. 2, the process cartridge 121 includes a drum-shaped photoconductor 10, a cleaning device 1 placed in the vicinity of the photoconductor 10, a charging unit 40, and a developing unit 50.

The cleaning device 1 presses the edge line portion 61 of a cleaning blade 5 against the surface of the photoconductor 10. The cleaning blade 5 is a strip-shaped elastic member that is long in the direction of the rotational axis of the photoconductor 10. The edge line portion 61 is an edge line that extends in a direction perpendicular to the direction of rotation of the photoconductor. With this structure, adhering matter such as transfer residual toner adhering to the surface of the photoconductor 10 is separated and removed from the surface of the photoconductor 10. The removed adhering matter such as toner is then ejected from the cleaning device 1 by an ejecting screw 43.

The charging unit 40 is formed mainly with a charging roller 41 facing the photoconductor 10, and a charging roller cleaner 42 that rotates in contact with the charging roller 41.

The developing unit (developing device) 50 supplies toner to the surface of the photoconductor 10 and turns an electrostatic latent image into a visible image, and includes a developing roller 51 as a developer bearer that bears a developer (carrier, toner) on its surface. The developing unit 50 is formed mainly with this developing roller 51, a stiffing screw 52 that conveys the developer housed in a developer container unit while stirring the developer, and a supplying screw 53 that conveys the stirred developer while supplying the stirred developer to the developing roller 51.

Each of the four process cartridges 121 having the above described structure can be individually detached and exchanged for a new one by a maintenance engineer or a user. As for a process cartridge 121 detached from the printer 100, each of the photoconductor 10, the charging unit 40, the developing unit 50, and the cleaning device 1 can be individually exchanged for a new one. Each process cartridge 121 may include a toner waste tank that houses transfer residual toner collected by the cleaning device 1. In this case, if the toner waste tank can be individually detached and exchanged for a new one in each process cartridge 121, a higher level of user-friendliness is achieved.

Referring to FIGS. 1 and 2, operation of the printer 100 is described.

The printer 100 receives a printing instruction from an operation panel (not shown) or an external device such as a personal computer. First, each photoconductor 10 is rotated in the moving direction (the rotational direction) indicated by an arrow A in FIG. 2, and the surface of each photoconductor 10 is uniformly charged with a predetermined polarity by the charging roller 41 of the charging unit 40. The exposure device 140 irradiates the charged photoconductors 10 with laser beams for the respective colors that are optically modulated in accordance with input color image data, and thus forms electrostatic latent images for the respective colors on the surfaces of the respective photoconductors 10. Developers of the respective colors are supplied to the respective electrostatic latent images from the developing rollers 51 of the developing units 50 for the respective colors, and the electrostatic latent images in the respective colors are developed with the developers for the respective colors and are turned into visible images that are toner images corresponding to the respective colors.

A transfer voltage of the polarity that is the opposite of the polarity of the toner is then applied to the primary transfer rollers 161, so that a primary transfer field is formed between each photoconductor 10 and each corresponding primary transfer roller 161, with the intermediate transfer belt 162 being interposed. At the same time, the primary transfer rollers 161 weakly presses against the intermediate transfer belt 162, so that primary transfer nips are formed. Through these actions, primary transfer of the toner images on the respective photoconductors 10 onto the intermediate transfer belt 162 is efficiently performed. The toner images in the respective colors formed by the respective photoconductors 10 are transferred onto the intermediate transfer belt 162 in an overlapping manner, and a stacked toner image is formed.

At a predetermined time, a transfer paper sheet stored in a sheet feeding cassette 131 is fed to the stacked toner image transferred onto the intermediate transfer belt 162 by the primary transfer via the corresponding sheet feeding roller 132, the pair of registration rollers 133, and the like. A transfer voltage of the polarity that is opposite to the polarity of the toner is then applied to the secondary transfer roller 165, so that a secondary transfer field is formed between the intermediate transfer belt 162 and the secondary transfer roller 165, with the transfer paper sheet being interposed, and the stacked toner image is transferred onto the transfer paper sheet. The transfer paper sheet onto which the stacked toner image has been transferred is sent to the fixing device 30, and fixing is performed with heat and pressure. The transfer paper sheet onto which the toner image has been fixed is ejected to the ejected paper housing unit 135 by the paper ejection rollers. Meanwhile, the transfer residual toner remaining on each respective photoconductor 10 after the primary transfer is scraped off and removed with the cleaning blade 5 of each corresponding cleaning device 1.

Next, the cleaning blade 5 of each cleaning device 1, which is the characteristic component of this printer 100, is described.

First, the problems with conventional cleaning blades are described. FIGS. 3A and 3B are schematic diagrams for explaining a conventional cleaning blade. A conventional cleaning blade 200 includes a single-layer blade member 201 in which the entire strip-shaped member is formed with a uniform elastic member, and a supporting member 202 that fixes the blade member 201 to the main frame of the cleaning device and is made of a material having high rigidity, such as a metal. Specifically, the blade member 201 is fixed to one end of the supporting member 202 with an adhesive agent or the like, and the other end of the supporting member 202 is cantilevered by the main frame of the cleaning device. As an edge line portion 203 that is an edge line extending in a direction perpendicular to the rotational direction of a photoconductor (not shown) serving as the member to be cleaned, the blade member 201 removes adhering matter such as transfer residual toner or a toner additive adhering to the surface of the photoconductor.

The blade member 201 of a cleaning blade is expected to be in contact with the surface of a photoconductor with a high contact pressure so as to achieve excellent removal performance, and the initial contact state is required to be maintained to achieve stable removal performance over a long period of time. However, with the single-layer blade member 201 in which the entire blade member is made of a uniform elastic material, it is difficult to increase the contact pressure and maintain the initial contact state at the same time. The reasons for this are as follows.

As shown in FIG. 3A, when a single-layer blade member 201 made of an elastic material having a relatively high degree of hardness such as urethane rubber is used, deformation of the edge line portion 203 in contact with an image bearer is small, and increases in the contact area can be restrained. Accordingly, the contact pressure can be made higher, and the cleaning performance can be improved. However, an elastic material having a high degree of hardness generally has a high permanent elongation rate. The blade member 201 is brought into contact with a photoconductor and is bent, with the edge line portion 203 being pressed against the circumferential surface of the photoconductor. If the blade member 201 made of the elastic material having a high permanent elongation rate is in contact with the photoconductor over a long period of time, the blade member 201 is permanently deformed in a bent shape, or permanent deformation occurs. As a result, the contact state becomes different from the initial contact state, causing defective cleaning.

As shown in FIG. 3B, in a case where the entire blade member 201 is made of an elastic material having a relatively low degree of hardness, permanent deformation hardly occurs even if the blade member 201 is in contact with a photoconductor over a long period of time, because an elastic material having a low degree of hardness generally has a low permanent elongation rate. Accordingly, the initial contact state can be maintained. However, the deformation of the edge line portion 203 in contact with the photoconductor is large, and the contact area becomes larger accordingly. As a result, the contact pressure becomes lower, and the cleaning performance becomes insufficient.

As described above, with a single-layer blade member, it is difficult to increase the contact pressure and maintain the initial contact state at the same time. Therefore, it is difficult to stably achieve high cleaning performance over a long period of time.

As shown in FIG. 4, another conventional cleaning blade 300 includes: a blade member 301 having a double-layer stack structure formed with an edge layer 301*a* that is the layer to be in contact with a photoconductor (not shown), and a backup layer 301*b* stacked on the back surface of the edge layer 301*a*; and a supporting member 302. The edge layer 301*a* is made of a urethane rubber having a high degree of hardness and a high permanent elongation rate, and the backup layer 301*b* is made of a urethane rubber having a low degree of hardness and a low permanent elongation rate. A single-layer blade member is too rigid to be sufficiently bent when being brought into contact with a photoconductor. As a result, the cleaning blade cannot adequately cope with unevenness or the like of the surface of the photoconductor, and the cleaning properties are degraded. In the blade member having a double-layer stack structure, on the other hand, the backup layer 301*b* has reasonable elasticity, and the edge layer 301*a* including the edge line portion has an increased degree of hardness. Accordingly, the cleaning blade can appropriately cope with unevenness or the like of the surface of the photoconductor, and excellent cleaning properties can be guaranteed. In the blade member 301 having such a double-layer structure, deformation of the edge line portion 303 in contact with the photoconductor as the member to be cleaned is small, and increase in the contact area can be restrained. Accordingly, the contact pressure can be made higher. Furthermore, the degree of hardness of the backup layer 301*b* not in contact with the photoconductor is low, and the rate of permanent elongation of the backup layer 301*b* is low. Accordingly, permanent deformation does not occur as easily as that in the above described single-layer blade member 201 having a high degree of hardness, and the initial contact state can be maintained.

However, if the strength of the elastic material of the edge layer 301*a* is further increased so as to improve cleaning performance by reducing adhesion of the toner additive to the surface of the photoconductor and to the charging roller, there is a limit to the increase in the strength in the case of the double-layer blade member 301. In a case where a urethane rubber having a low rate of permanent elongation is used as the backup layer 301*b*, the permanent elongation of the edge layer 301*a* using an elastic material having a higher degree of strength becomes dominant. As a result, a decrease in the contact pressure and defective cleaning due to permanent deformation become problems. A decrease in permanent elongation can be corrected by reducing the thickness of the edge layer 301*a* by a possible amount. However, the strength of the elastic material used as the edge layer 301*a* cannot be made infinitely higher, and there is a limit to the increase in the strength of the elastic material due to the relationship with permanent deformation. Therefore, with a double-layer blade member, there is a limit to the increase in the strength of the edge line portion for improving cleaning performance by reducing adhesion of the toner additive to the surface of a photoconductor and to the charging roller.

FIGS. 5A and 5B are schematic diagrams for explaining yet another conventional cleaning blade. FIG. 6 is a schematic diagram for explaining an impregnation treatment. FIG. 7 is a schematic diagram for explaining deformation of the blade member when a cleaning blade is brought into contact with a photoconductor. The conventional cleaning blade 400 shown in FIGS. 5A and 5B includes a strip-shaped single-layer blade member 401, and a supporting member 402 that fixes the blade member 401 to the main frame of the cleaning device and is made of a material having high rigidity, such as a metal. In the cleaning blade 400, so as to increase the strength of the edge line portion 403, the single-layer urethane rubber blade member 401 is impregnated with acrylic resin or isocyanate resin, and an impregnated portion 404 is formed, as shown in FIG. 5A. Alternatively, coating is performed on part of or all of the impregnated portion 404, and a surface layer 407 is formed, as shown in FIG. 5B. As shown in FIG. 6, the impregnation treatment is performed by immersing the blade member 401 of the cleaning blade 400 in an impregnating coating solution perpendicularly to the liquid level of the impregnating coating solution. Other than the method involving immersion in an impregnating coating solution, the impregnation treatment may be performed by brush coating, spray coating, dip coating, or the like. The impregnated portion 404 having the elastic material strength increased through the impregnation treatment is formed in a portion including the edge line portion 403, and in the photoconductor-facing surface 405 and the non-photoconductor-facing surface 406 that are adjacent to each other across the edge line portion 403. When being brought into contact with a photoconductor 408 as shown in FIG. 7, the cleaning blade 400 is deformed such that the portion of the photoconductor-facing surface 405 expands and the portion of the non-photoconductor-facing surface 406 contracts. In this manner, the cleaning blade 400 evenly comes into contact with the photoconductor 408.

However, in a case where the blade member 401 having the impregnated portion 404 is brought into contact with a photoconductor (not shown), the non-photoconductor-facing surface 406 other than the edge line portion 403 has its strength increased by the impregnation treatment. Therefore, as shown in FIG. 7, the portion of the photoconductor-facing surface 405 does not easily expand, the portion of the non-photoconductor-facing surface 406 does not easily contract, and the edge line portion 403 does not easily bend. As a result, the contact with the photoconductor 408 becomes uneven, and the uneven contact causes degradation in cleaning performance. Also, as shown in FIG. 7, stress from the non-photoconductor-facing surface 406 (indicated by a solid-line arrow in FIG. 7) concentrates on the edge line portion 403. Therefore, unnecessarily high stress is applied to the edge line portion 403, and the edge line portion 403 easily becomes worn, resulting in a problem in terms of durability.

In view of the above, when the single-layer blade member 501 of a cleaning blade 500 is immersed in an impregnating coating solution obliquely with respect to the liquid level, as shown in FIG. 8, which is a schematic diagram for explaining another impregnation treatment, an impregnated portion 504 is formed on an edge line portion 503 and part of a cut surface 507 formed to be interposed between a photoconductor-facing surface 505 and a non-photoconductor-facing surface 506 and continue to the both surfaces, and the non-photoconductor-facing surface 506 is not immersed in the impregnating coating solution, as shown in FIG. 9. With this arrangement, the portion of the non-photoconductor-facing surface 506 is deformed so as to sufficiently contract, and the portion of the photoconductor-facing surface 505 is deformed so as to sufficiently expand. Accordingly, the flexibility of the edge line portion 503 is maintained. In this manner, the contact with a photoconductor (not shown) as the member to be cleaned becomes uniform, and a sufficient effect to increase the strength of the edge line portion 503 is achieved. Thus, cleaning performance can be improved by reducing adhesion of the toner additive to the surface of the photoconductor and to the charging roller.

However, even in a case where the impregnated portion 504 is formed on the portions of the edge line portion 503 and the cut surface 507 but is not formed on the portion of the non-photoconductor-facing surface 506 as in the cleaning blade 500 shown in FIG. 9, there is the problem described below if a single-layer blade member is used. Specifically, in view of permanent elongation, the single-layer blade member 501 needs to be made of an elastic material that has a low rate of permanent elongation and a relatively low degree of hardness, as described above. However, in a case where an elastic material having a low degree of hardness is used as the base material so as to increase the hardness of the edge line portion 503 through an impregnation treatment, the amount of impregnation needs to be made larger than that in a case where an elastic material having a high degree of hardness is used as the base material. Therefore, the impregnation time needs to be made longer, or the concentration of the impregnating coating solution needs to be made higher. This results in an increase in cost due to the elongated production time, or an increase in the cost of the impregnating coating solution due to the increased concentration of the impregnating coating solution.

Next, the principal characteristics of the above described conventional cleaning blades and example cleaning blades according to this embodiment are described in conjunction with the results of verification experiments. In the verification experiments described below, the principal characteristics such as the Young's moduli and the rates of permanent elongation of the respective components of each blade member were measured.

Experiment 1

FIG. 10 is a schematic diagram for explaining a cleaning blade having a double-layer blade member. It should be noted that any impregnation treatment has not been performed on the blade member shown in FIG. 10. The principal characteristics of Experiment 1 are shown in Table 1.

TABLE 1

| | Edge layer | Backup layer | Entire blade member |
|---|---|---|---|
| Young's modulus [MPa] | 16.1 | 6.5 | 8.3 |
| Permanent elongation [%] | 3.2 | 0.5 | 1.4 |
| Elastic power [%] | 87.5 | 74.6 | — |
| Martens hardness [N/mm$^2$] | 1.8 | 1.0 | — |
| Rubber thickness [mm] | 0.5 | 1.3 | 1.8 |

In a cleaning blade 600 that includes the double-layer blade member 601 shown in FIG. 10, the edge layer 601*a* of the blade member 601 is made of a urethane rubber having a high Young's modulus (16.1 MPa) (high strength), so as to improve cleaning performance, reduce adhesion of the toner additive to the surface of a photoconductor, and reduce staining of the charging roller. As described above, there is a correlation between permanent elongation of a cleaning blade and the decrease in contact pressure due to permanent deformation over time. As the rate of permanent elongation becomes higher, the contact pressure tends to become lower. Normally, permanent deformation becomes a problem, when the rate of permanent elongation exceeds 3.0%. The urethane rubber used as the edge layer 601*a*, which is a single layer, has a permanent elongation rate of 3.2%, as shown in Table 1. Since the rate of permanent elongation is higher than 3.0%, permanent deformation becomes a problem in a cleaning blade having a single-layer blade member. In view of this, a urethane rubber that has a low Young's modulus (6.5 MPa) (low strength) and a permanent elongation rate of 0.5% is used as the backup layer 601*b* to realize a double-layer structure. As a result, the permanent elongation rate of the entire blade member 601 becomes 1.4%, which is not higher than 3.0% and does not cause the problem of permanent deformation.

Experiment 2

FIG. 11 is a schematic diagram for explaining a cleaning blade having a double-layer blade member. It should be noted that any impregnation treatment has not been performed on the blade member shown in FIG. 11. The film thicknesses and the sizes of the respective layers are the same as those of the cleaning blade used in Experiment 1. The principal characteristics of Experiment 2 are shown in Table 2.

TABLE 2

| | Edge layer | Backup layer | Entire blade member |
|---|---|---|---|
| Young's modulus [MPa] | 28.5 | 6.5 | 14.5 |
| Permanent elongation [%] | 8.3 | 0.5 | 4.3 |
| Elastic power [%] | 39.6 | 74.6 | — |
| Martens hardness [N/mm$^2$] | 6.5 | 1.0 | — |
| Rubber thickness [mm] | 0.5 | 1.3 | 1.8 |

In a cleaning blade 700 that includes the double-layer blade member 701 shown in FIG. 11, the edge layer 701*a* of the blade member 701 is made of a high-hardness urethane rubber having an even higher Young's modulus (28.5 MPa) than that in Experiment 1, so as to improve cleaning performance, reduce adhesion of the additive to the surface of a photoconductor, and reduce staining of the charging roller more effectively than in Experiment 1. The urethane rubber used as the edge layer 701*a*, which is a single layer, has a permanent elongation rate of 8.3%, which is much higher than 3.0%, as shown in Table 2. Therefore, even if a urethane rubber that has a permanent elongation rate of 0.5% is used as the backup layer 701*b* to realize a double-layer structure, the permanent elongation rate of the entire blade member 701 is 4.3%, which is higher than 3.0% and causes the problem of permanent deformation. This is supposedly because the permanent elongation rate of the edge layer 701*a* is higher than that of the backup layer 701*b*, and the permanent elongation of the edge layer 701*a* becomes dominant in the permanent elongation of the entire blade member, as described above.

Experiment 3

FIG. 12 is a schematic diagram for explaining a cleaning blade having a double-layer blade member. It should be noted that any impregnation treatment has not been performed on the blade member shown in FIG. 12. The principal characteristics of Experiment 3 are shown in Table 3.

TABLE 3

| | First edge layer | Second edge layer | Backup layer |
|---|---|---|---|
| Young's modulus [MPa] | 28.5 | 16.1 | 6.5 |
| Permanent elongation [%] | 8.3 | 3.2 | 0.5 |
| Elastic power [%] | 39.6 | 87.5 | 74.6 |
| Martens hardness [N/mm$^2$] | 6.5 | 1.8 | 1.0 |

In a cleaning blade 800 that includes the double-layer blade member 801 shown in FIG. 12, the portion of a photoconductor-facing surface 804 is formed with a first edge layer 805 as the cleaning layer and a second edge layer 806 as the edge layer. The first edge layer 805 is formed in a portion including an edge line portion 803, and becomes gradually thicker in the direction toward the edge line portion 803. The first edge layer 805 is made of an elastic material that has a Young's modulus of 28.5 Mpa and a permanent elongation rate of 8.3%, which is not desirable in terms of permanent elongation. The proportion of the portion of the first edge layer 805 to the photoconductor-facing surface 804 is lower than that of the portion of the second edge layer 806. Therefore, the permanent elongation of the second edge layer 806 is dominant in the permanent elongation of the entire blade member, and the permanent elongation rate of the entire blade member is 1.4%, which is not higher than 3.0%. Thus, permanent deformation over time can be reduced, and high cleaning performance can be maintained over a long period of time by virtue of the effect to reduce adhesion of the toner additive to the surface of a photoconductor and the effect to reduce staining of the charging roller.

Next, the elastic power of the cleaning layer is described.

In the cleaning blade shown above in Table 3, the first edge layer (the cleaning layer) is made of an elastic material having a high Young's modulus. The elastic power of this material is 39.6%. Normally, when the Young's modulus of an elastic material is made larger, the value of the elastic power thereof tends to become smaller. The elastic power is a value indicating a relation between elastic workload and plastic workload, and indicates plastic deformability of the material. In a cleaning blade, the plastic deformability of the edge line portion to be in contact with a photoconductor greatly affects toner removal performance. That is, if the edge line portion of a cleaning blade has a high degree of plastic deformability, part of the edge line of the cleaning blade is once deformed downstream in the photoconductor moving direction by the frictional force between the cleaning blade and the photoconductor. In that case, the original edge shape is not easily restored, and toner easily escapes through the site. As a result, a streaky abnormal image is obtained due to defective cleaning that is caused by the streaky toner escape. Since toner easily continues to escape through the same site, part of the edge line portion becomes locally worn. Such degradation of cleaning properties due to a low elastic power occurs notably in low-temperature environments.

In the case of a cleaning blade in which the elastic power of the cleaning layer is high, and the portion in the vicinity of the edge line portion has a low plastic deformation rate, even if part of the edge line is deformed downstream in the photoconductor moving direction, the original shape is promptly restored. Therefore, defective cleaning due to streaky escape of toner, and an abnormal image are hardly caused. Further, part of the edge line portion does not become locally worn.

As for the above described defective cleaning and the local wear, the relation between the elastic material used as the cleaning layer and its elastic power was examined through Experiment 4, which is described below.

Experiment 4

In Experiment 4, as opposed to the cleaning blade shown in Table 3 (hereinafter referred to as the "cleaning blade 3-1"), two kinds of cleaning blades 3-2 and 3-3 that differed from each other in the elastic power of the first edge layer were prepared, and the respective edge line portions were compared with one another in terms of plastic deformation. In Experiment 4, the cleaning blades 3-1, 3-2, and 3-3 were brought into contact with a photoconductor at a linear pressure of 20 g/cm in a 0-° C. environment, and the photoconductor was rotated by ten revolutions in a no-toner input state that generated a higher frictional force than a toner input state. The diameter of the photoconductor was 30 mm. As shown in FIGS. 13A through 14, after the photoconductor was rotated, the edge line of each blade was observed with a microscope, and the deformation amount generated by plastic deformation was calculated. The plastic deformation amounts of the edge lines are shown below in Table 4. The cleaning blade 3-1 having an elastic power of 39.6% was hardly deformed. On the other hand, the maximum plastic deformation amounts of the cleaning blades 3-2 and 3-3 were 0.8 μm and 1.1 μm, respectively.

In view of the above, by adjusting the elastic power of the portion of the cleaning layer in the vicinity of the edge line portion to be approximately 40% or higher, neither defective cleaning due to plastic deformation nor local wear is caused in a low-temperature environment, even if an elastic material with a high Young's modulus is used.

TABLE 4

| Cleaning blade | 3-1 | 3-2 | 3-3 |
|---|---|---|---|
| Young's modulus [MPa] | 28.5 | 36.2 | 42.1 |
| Permanent elongation [%] | 8.3 | 18.4 | 32.6 |
| Elastic power [%] | 39.6 | 38.2 | 36.4 |
| Martens hardness [N/mm$^2$] | 6.5 | 7.8 | 8.6 |
| Deformation amount [μm] | To 0.05 | 0.5 to 0.8 | 0.8 to 1.1 |

Experiment 5

FIG. 15 is a schematic diagram for explaining a cleaning blade having a double-layer blade member. It should be noted that any impregnation treatment has not been performed on the blade member shown in FIG. 15. The principal characteristics of Experiment 5 are shown in Table 5.

TABLE 5

| | First edge layer | Second edge layer | Backup layer |
|---|---|---|---|
| Young's modulus [MPa] | 16.1 | 28.5 | 6.5 |
| Permanent elongation [%] | 3.2 | 8.3 | 0.5 |
| Elastic power [%] | 87.5 | 39.6 | 74.6 |
| Martens hardness [N/mm$^2$] | 1.8 | 6.5 | 1.0 |

In a cleaning blade 900 that includes the double-layer blade member 901 shown in FIG. 15, the portion of a photoconductor-facing surface 904 is formed with a first edge layer 905 and a second edge layer 906. The first edge layer 905 is formed near an edge line portion 903, and becomes gradually thicker in the direction toward the edge line portion 903. The Young's modulus of the first edge layer 905 is 16.1 MPa, which is lower than that of the first edge layer 805 shown in FIG. 12, and the strength of the portion including the edge line portion 903 is not sufficient. Therefore, the cleaning performance is poorer than that of the cleaning blade 800 shown in FIG. 12, and the reduction of adhesion of the toner additive to the photoconductor surface and the reduction of staining of the charging roller are smaller than those by the cleaning blade 800. The proportion of the portion of the second edge layer 906 to the photoconductor-facing surface 804 is higher than that of the portion of the first edge layer 905.

Therefore, the permanent elongation due to the Young's modulus of the second edge layer 906 is dominant, and cleaning performance is degraded due to permanent deformation over time.

As can be seen from the results of the verification experiments in Experiments 1 through 3 and Experiment 5, the degree of hardness (strength or Young's modulus) of the edge line portion needs to be made higher, so as to realize excellent cleaning performance through a reduction of adhesion of the additive to the photoconductor surface and a reduction of staining of the charging roller. For example, as shown in each of FIGS. 16, 17, 18, and 19, the first edge layer is provided most upstream in the photoconductor moving direction, and the second edge layer is provided downstream of the first edge portion. Also, the first edge layer has the highest Young's modulus. So as to reduce permanent deformation that occurs over time, the second edge layer has a lower Young's modulus than that of the first edge layer, and the backup layer has a lower Young's modulus than that of the second edge layer. The backup layer is in contact with the side of the first edge layer and/or the second edge layer opposite to the side of the second edge layer and the edge line portion facing the photoconductor.

In the blade member 1001 of a cleaning blade 1000 shown in FIG. 16, a first edge layer 1005 is formed in a portion including an edge line portion 1003, and the film thickness thereof may become gradually thicker in the direction toward the edge line portion 1003. In the blade member 1101 of a cleaning blade 1100 shown in FIG. 17, a first edge layer 1105 is formed in a portion including an edge line portion 1103, and may be formed over an edge 1101*a* and a backup layer 1101*b*. In the blade member 1201 of a cleaning blade 1200 shown in FIG. 18, a first edge layer 1205 and a second edge layer 1206 may be formed so that the film thickness of each of the edge layers 1205 and 1206 becomes gradually thicker in the direction toward an edge line portion 1203. In the blade member 1301 of a cleaning blade 1300 shown in FIG. 19, the portion of the photoconductor-facing surface 1304 of an edge layer 1301*a* may be formed with a first edge layer 1305 that is made of a high-hardness elastic material and is located in a portion including an edge line portion 1303, and a second edge layer 1306 made of a low-hardness elastic material.

EXAMPLE

Next, an example of a cleaning blade according to the above described embodiment is described.

FIG. 20 is a schematic diagram for explaining the example of a cleaning blade. The cleaning blade 1400 of the example shown in FIG. 20 includes a double-layer blade member 1401 formed with an edge layer 1401*a* and a backup layer 1401*b* that are made of elastic materials having different degrees of hardness from each other, and a supporting member 1402 that fixes the blade member 1401 to the main frame of the cleaning device and is made of a material having high rigidity, such as a metal. Specifically, the blade member 1401 is fixed to one end of the supporting member 1402 with an adhesive agent or the like, and the other end of the supporting member 1402 is cantilevered by the main frame of the cleaning device. In the blade member 1401, an impregnation treatment is performed, so that a region extending from the edge layer 1401*a* to the backup layer 1401*b* in a portion including an edge line portion 1403 is impregnated with resin. In this manner, an impregnated portion 1405 as the cleaning layer is formed. Specifically, a portion including the edge line portion 1403 is impregnated with acrylic resin or the like, so that the impregnated portion 1405 has a degree of hardness increased through ultraviolet curing. The principal characteristics of the cleaning blade of this example are shown below in Table 6. The degrees of Martens hardness [N/mm$^2$] in Table 5 are characteristic values for comparing the impregnated portion subjected to the impregnation treatment with the edge layer and the backup layer. The impregnated portion 1405 shown in FIG. 20 is an impregnated portion extending approximately 100 μm along the photoconductor-facing surface 1404 from the edge line portion 1403. Since this is an extremely narrow region, it is difficult to detect changes in macroscopic characteristics such as a Young's modulus before and after the impregnation treatment. Therefore, there are no numerical values that represent minute changes in hardness and indicate the effect of the impregnation treatment.

TABLE 6

| | Impregnated portion | Edge layer | Backup layer |
|---|---|---|---|
| Young's modulus [MPa] | — | 16.1 | 6.5 |
| Permanent elongation [%] | — | 3.2 | 0.5 |
| Elastic power [%] | 49.5 | 87.5 | 74.6 |
| Martens hardness [N/mm$^2$] | 6.2 (measured at site 20 μm away from edge line portion)<br>3.7 (measured at site 10 μm away from edge line portion) | 1.8 | 1.0 |

TABLE 6-continued

| | Impregnated portion | Edge layer | Backup layer |
|---|---|---|---|
| Rubber thickness [mm] | — | 0.5 | 1.3 |

Comparative Example

Next, a comparative example of a cleaning blade is described.

FIG. 21 is a schematic diagram for explaining a comparative example of a cleaning blade. The cleaning blade 1500 of the comparative example shown in FIG. 21 includes a strip-shaped single-layer blade member 1501, and a supporting member 1502 that fixes the blade member 1501 to the main frame of the cleaning device and is made of a material having high rigidity, such as a metal. In the single-layer blade member 1501 shown in FIG. 21, an impregnation treatment is performed on a portion including an edge line portion 1503, to form an impregnated portion 1505. The portion including the edge line portion 1503 is impregnated with an impregnating coating solution such as acrylic resin, so that the impregnated portion 1505 has a degree of hardness increased through ultraviolet curing. The principal characteristics of the cleaning blade of this example are shown below in Table 7.

TABLE 7

| | Impregnated portion | Blade member |
|---|---|---|
| Young's modulus [MPa] | — | 6.5 |
| Permanent elongation [%] | — | 0.5 |
| Elastic power [%] | 47.8 | 74.6 |
| Martens hardness [N/mm$^2$] | 6.1 (measured at site 20 μm away from edge line portion) | 1.0 |
| Rubber thickness [mm] | — | 1.8 |

The cleaning blade 1400 shown in FIG. 20 and the cleaning blade 1500 shown in FIG. 21 are immersed in and impregnated with the same impregnating coating solution, but require different impregnation treatment periods to obtain the target Martens hardness (at a site 20 μm away from the edge line portion, for example). If the Young's modulus of the rubber member prior to the impregnation treatment is low or the Martens hardness is low, a long impregnation treatment period is required to achieve the target Martens hardness, and the impregnated region becomes wider. Also, the high-hardness region expands outside the region surrounding the edge line portion. Therefore, as the high-strength region becomes larger, the contact portion of the blade member is not evenly brought into contact with the surface of a photoconductor as the member to be cleaned, and cleaning performance is degraded.

As described above, rather than performing the impregnation treatment on a single-layer blade member with low strength as shown in FIG. 21, by performing the impregnation treatment on a double-layer blade member that is formed with a high-hardness edge layer and a low-hardness backup layer as shown in FIG. 20, a structure with even higher strength is obtained. As only the edge line portion is made to have the target high degree of hardness as described above, the impregnation treatment period is shortened. Accordingly, productivity is increased, costs can be lowered, and permanent deformation over time can be reduced. At the same time, excellent cleaning performance can be maintained through a reduction of adhesion of the toner additive to the surface of a photoconductor and a reduction of staining of the charging roller.

Also, as in a cleaning blade 1600 that is a first modification shown in FIG. 22, an impregnated portion 1605 may be formed by performing the impregnation treatment only on the portion of the edge line portion 1603 of an edge layer 1601*a* while not performing the impregnation treatment on the portion of a backup layer 1601*b*. As in a cleaning blade 1700 that is a second modification shown in FIG. 23, an impregnated portion 1705 may be formed by performing the impregnation treatment on a portion that extends from an edge layer 1701*a* to a backup layer 1701*b* and includes an edge line portion 1703. As shown in FIG. 24, in a cleaning blade 1800 that is a third modification, an edge layer 1801*a* may be designed so that the film thickness thereof becomes gradually greater in the direction toward an edge line portion 1803, and an impregnated portion 1805 may be formed by performing the impregnation treatment only on a portion of the edge layer 1801*a* including the edge line portion 1803. As shown in FIG. 25, in a cleaning blade 1900 that is a fourth modification, an edge layer 1901*a* may be designed such that the film thickness thereof becomes gradually greater in the direction toward an edge line portion 1903, and an impregnated portion 1905 may be formed by performing the impregnation treatment only on a portion that extends from the edge layer 1901*a* to a backup layer 1901*b* and includes the edge line portion 1903. As in the cleaning blades 1600, 1700, 1800, and 1900 of the first through fourth modifications shown in FIGS. 22 through 25, the impregnation treatment is performed on a portion including the edge line portion of a double-layer blade member, so that the double-layer blade member includes at least an edge layer, a backup layer, and an impregnated portion (the cleaning layer). Accordingly, permanent deformation over time can be reduced more effectively than in a single-layer blade member having the impregnation treatment performed on a portion including the edge line portion, and excellent cleaning performance can be maintained through a reduction of adhesion of the toner additive to the surface of a photoconductor and a reduction of staining of the charging roller more effectively than in the single-layer blade member.

The impregnation treatment for impregnating the cleaning blade 5 shown in FIG. 2 with an ultraviolet curable resin can be performed by brush coating, spray coating, dip coating, or the like. The ultraviolet curable resin for impregnation is preferably a material that has a Martens hardness of 250 to 500 N/mm$^2$, and an elastic power of 75% or lower, or more preferably, an elastic power of 50 to 75%. The Martens hardness and the elastic power of the ultraviolet curable resin for impregnation are the results of measurement carried out on a resin film that was formed on a glass substrate and had a thickness of 5 to 10 μm. With this arrangement, the edge line portion 61 of the cleaning blade 5 brought into contact with the photoconductor 10 as shown in FIG. 2 can be prevented from being deformed in the moving direction of the photoconductor surface. Furthermore, when the inside is exposed due to wear of the surface layer over time, deformation can also be prevented by virtue of an action of inward impregnation.

The Martens hardness as the hardness of the ultraviolet curable resin was measured with a microhardness measurement instrument, HM-2000, manufactured by Fischer Instruments K.K. Specifically, the ultraviolet curable resin is applied onto a glass substrate so that the thickness becomes 20 μm. A Vickers indenter is pushed into the applied ultraviolet curable resin with a force of 9.8 mN in 30 seconds, and is kept therein for five seconds. The Vickers indenter is then pulled out with a force of 9.8 mN in 30 seconds. Measurement is carried out in this manner. The elastic power is a characteristic value that is calculated, as described below, from the total stress obtained at the time of the Martens hardness measurement. Where the total stress caused when the Vickers indenter is pushed into the ultraviolet curable resin is represented by Wplast, and the total stress caused when the test load is removed is represented by Welast, the elastic power is a characteristic value defined by the expression, Welast/Wplast×100% (see FIG. 26). A higher elastic power means smaller hysteresis loss (plastic deformation) or greater rubbery characteristics. If the elastic power is too low, the ultraviolet curable resin is more like glass than rubber.

The Martens hardness of the portion in the vicinity of the edge line portion 61 shown in FIG. 2 is the Martens hardness measured when the cleaning blade 5 was impregnated with an ultraviolet curable resin, and differs from the Martens hardness of the above described ultraviolet curable resin.

The ultraviolet curable resin for the impregnation treatment is preferably a material having high hardness and high elasticity, such as an acrylate or methacrylate having a tricyclodecane or adamantane skeleton. The toner removal performance is greatly improved, and the wear of the cleaning blade is reduced. Accordingly, excellent cleaning performance can be maintained over a long period of time. Also, the coefficient of friction between the cleaning blade and the photoconductor is reduced, and the wear of the photoconductor is reduced. Accordingly, the life of the photoconductor and the life of the image forming apparatus can be prolonged. Further, as the cleaning blade does not rub the toner additive or the like against the surface of the photoconductor, any abnormal image with blanks is not generated. The acrylate or methacrylate having a tricyclodecane or adamantane skeleton is preferable, because the special structure of a tricyclodecane or adamantane skeleton can compensate for shortage of cross-linking points, even if the number of functional groups is small. Examples of acrylates or methacrylates having a tricyclodecane or adamantane skeleton include tricyclodecane dimethanol diacrylate, 1,3-adamantane dimethanol diacrylate, 1,3-adamantane dimethanol dimethacrylate, 1,3,5-adamantane trimethanol triacrylate, and 1,3,5-adamantane trimethanol trimethacrylate. A mixture of two or more of these materials may be used.

The number of functional groups of the acrylate or methacrylate having a tricyclodecane or adamantane skeleton is preferably one to six, and more preferably, two to four. If the number of functional groups is one, the cross-linked structure is weak. If the number of functional groups is five or greater, steric hindrance might occur. Therefore, it is preferable to mix acrylates or methacrylates having different numbers of functional groups. The molecular weight of the acrylate or methacrylate having a tricyclodecane or adamantane skeleton is preferably 500 or smaller. If the molecular weight is 500 or greater, the molecular size becomes larger. As a result, the cleaning blade is not easily impregnated with the ultraviolet curable resin, and it becomes difficult to achieve a higher degree of hardness.

An acrylate monomer of 100 to 1500 in molecular weight may be mixed with the impregnating coating solution for impregnating the cleaning blade 5 with an ultraviolet curable resin by brush coating, spray coating, dip coating, or the like. Examples of acrylate monomers include dipentaerythritol hexaacrylate, pentaerythritol tetraacrylate, pentaerythritol triacrylate, pentaerythritol ethoxy tetraacrylate, trimethylol propane triacrylate, trimethylol propane ethoxy triacrylate, 1,6-hexanediol diacrylate, ethoxylated bisphenol A diacrylate, propoxylated ethoxylated bisphenol A diacrylate, 1,4-butanediol diacrylate, 1,5-pentanediol diacrylate, 1,6-hexanediol diacrylate, 1,7-heptanediol diacrylate, 1,8-octanediol diacrylate, 1,9-nonanediol diacrylate, 1,10-decanediol diacrylate, 1,11-undecanediol diacrylate, 1,18-octadecanediol diacrylate, glycerin propoxy triacrylate, dipropylene glycol diacrylate, tripropylene glycol diacrylate, PO-modified neopentyl glycol diacrylate, PEG600 diacrylate, PEG400 diacrylate, PEG200 diacrylate, neopentyl glycol hydroxypivalic acid ester diacrylate, octyl/decyl acrylate, isobornyl acrylate, ethoxylated phenyl acrylate, and 9,9-bis[4-(2-acryloyloxyethoxy)phenyl]fluorene. One of these materials or two or more of these materials may be mixed with the impregnating coating solution.

The diluent for the impregnating coating solution can solve an ultraviolet curable resin, and preferably has a low boiling point. Particularly, the boiling point is not higher than 160° C., or more preferably, not higher than 100° C. Examples of diluting solvents that can be used herein are organic solvents including: hydrocarbon-based solvents such as toluene and xylene; esters such as ethyl acetate, n-butyl acetate, methyl cellosolve acetate, and propylene glycol monomethyl ether acetate; ketones such as methyl ethyl ketone, methyl isobutyl ketone, diisobutyl ketone, cyclohexanone, and cyclopentanone; ethers such as ethylene glycol monomethyl ether, ethylene glycol monoethyl ether, and propylene glycol monomethyl ether; alcohols such as ethanol, propanol, 1-butanol, isopropyl alcohol, and isobutyl alcohol.

The above diluent has the effect to facilitate impregnation at the time of coating. However, the above diluent might degrade physical properties and wear resistance, such as when a residual solvent exists in the rubber, and the rubber remains expanded and does not return to its original thickness. Also, if drying is conducted by heating so as to remove the residual solvent, the physical properties of the rubber are changed, and the cleaning properties might be degraded. In view of this, it is preferable to lower the temperature for the drying heat, or perform vacuum drying or the like, instead of drying by heating. In this manner, the density of the residual solvent can be lowered.

Next, specific examples of impregnating coating solutions are described.

Impregnating Coating Solution 1

Ultraviolet curable resin: Idemitsu Kosan Co., Ltd. X-DA 50 parts; number of functional group 2

Polymerization initiator: Ciba Specialty Chemicals Inc. IRGACURE 184 5 parts

Solvent: cyclohexanone 55 parts

Impregnating Coating Solution 2

Ultraviolet curable resin: Shin-Nakamura Chemicals Co., Ltd. A-DCP 50 parts; number of functional groups 2

Polymerization initiator: Ciba Specialty Chemicals Inc. IRGACURE 184 5 parts

Solvent: cyclohexanone 55 parts

Impregnating Coating Solution 3

Ultraviolet curable resin: Idemitsu Kosan Co., Ltd. X-A-201 50 parts; number of functional groups 2

Polymerization initiator: Ciba Specialty Chemicals Inc. IRGACURE 184 5 parts

Solvent: cyclohexanone 55 parts

Impregnating Coating Solution 4

Ultraviolet curable resin: Mitsubishi Gas Chemical Company, Inc. ADTM 50 parts; functional group 3

Polymerization initiator: Ciba Specialty Chemicals Inc. IRGACURE 184 5 parts

Solvent: cyclohexanone 55 parts

Impregnating Coating Solution 5

Ultraviolet curable resin 1: Shin-Nakamura Chemicals Co., Ltd. A-DCP 25 parts; number of functional groups 2

Ultraviolet curable resin 2: Daicel-Cytec Co., Ltd. PETIA 25 parts; functional group 3

Polymerization initiator: Ciba Specialty Chemicals Inc. IRGACURE 184 5 parts

Solvent: cyclohexanone 55 parts

Impregnating Coating Solution 6

Ultraviolet curable resin 1: Idemitsu Kosan Co., Ltd. X-A-201 25 parts; number of functional groups 2

Ultraviolet curable resin 2: Daicel-Cytec Co., Ltd. PETIA 25 parts; functional group 3

Polymerization initiator: Ciba Specialty Chemicals Inc. IRGACURE 184 5 parts

Solvent: cyclohexanone 55 parts

Impregnating Coating Solution 7

Ultraviolet curable resin: Daicel-Cytec Co., Ltd. PETIA 50 parts; functional group 3 Polymerization initiator: Ciba Specialty Chemicals Inc. IRGACURE 184 5 parts Solvent: cyclohexanone 55 parts Impregnating Coating Solution 8

Ultraviolet curable resin: Daicel-Cytec Co., Ltd. DPHA 50 parts; functional group 6 Polymerization initiator: Ciba Specialty Chemicals Inc. IRGACURE 184 5 parts Solvent: cyclohexanone 55 parts Next, the toner to be used in the printer 100 of this embodiment is described.

In this printer 100, a low-temperature fixing toner that has a glass transition temperature (Tg) of 40 to 60° C. is used so as to save energy in the fixing device 30 of the image forming apparatus.

So as to realize a toner that excels in low-temperature fixability, hot-offset resistance, and heat-resistant preservability, the toner of this embodiment is a polyester resin as a binder resin that satisfies the following conditions: 1) the glass transition temperature (Tg) is 39 to 65° C., and 2) the value (Mw/Tg) obtained by dividing the weight-average molecular weight (Mw) of the THF soluble portion by the glass transition temperature (Tg/° C.) is 40 to 120.

In the conventionally-used polyester resin, Mw tends to drop rapidly as Tg becomes lower than 65° C. Therefore, it is difficult for the conventionally-used polyester resin to excel in low-temperature fixability, hot-offset resistance, and heat-resistant preservability. If Tg of the polyester resin is lower than 39° C., the heat-resistant preservability cannot be improved, no matter how well Mw is adjusted. Therefore, the range of Tg that can keep the physical properties of the toner in balance is 39 to 65° C., and the range of the value of Mw/Tg is 40 to 120. As long as the value of Mw/Tg stays within the above range, the polyester resin has such Tg as to maintain excellent heat-resistant preservability, and the molecular weight can also be reduced. Accordingly, the low-temperature fixability of the toner can be further improved, and excellent heat-resistant preservability can be maintained. It should be noted that Mw and Tg are measured by the technique described below, and the unit of Tg in the value of Mw/Tg is ° C.

The glass transition temperature (Tg) is measured at a temperature rise rate of 10° C./min with Rigaku THRMOFLEX TG8110, manufactured by Rigaku Corporation.

The molecular weight is measured by GPC (gel permeation chromatography) as follows. A column is steadied in a heat chamber at 40° C., and THF is applied as the solvent at a flow rate of 1 ml/min to the column at the temperature. Measurement is then carried out by injecting 50 to 200 μl of a THF sample solution of a resin adjusted to a sample density of 0.05 to 0.6 wt. %. When the molecular weight of a sample is measured, the molecular weight distribution of the sample is calculated from the relation between the logarithmic value of the created calibration curve and the count number obtained from several kinds of monodisperse polystyrene standard samples. The appropriate standard polystyrene samples for creating a calibration curve are at least ten standard polystyrene samples, which are manufactured by Pressure-Chemical Co. or Tosoh Corporation, and have molecular weights of 6×102, 2.1×103, 4×103, 1.75×104, 5.1×104, 1.1×105, 3.9×105, 8.6×105, 2×106, and 4.48×106, for example. Here, an RI (refractive index) detector is used as the detector.

The chemical structure of the polyester resin that satisfies the above conditions preferably has the following features. Specifically, the molar ratio (benzene ring skeleton/1,4-cyclohexylene skeleton) between the benzene ring skeleton and the 1,4-cyclohexylene skeleton in the polyester resin is 2.0 to 15.0, and the molar ratio (benzene skeleton/double-end ester-bond alkylene skeleton) between the benzene skeleton and the alkylene skeleton having ester bonds at both ends is 3.0 or higher.

The glass transition temperature (Tg) of the polyester resin is governed mainly by its chemical structure, and Tg tends to become higher as the benzene ring skeleton extends longer or the content of the benzene ring skeleton becomes larger. Also, Tg tends to become lower, as the alkylene skeleton becomes longer or the content of the alkylene skeleton becomes larger. Therefore, if the content of the benzene ring skeleton is large, the hot-offset resistance and the heat-resistant preservability are improved, but the low-temperature fixability are degraded. If the content of the alkylene skeleton is large, the low-temperature fixability is advantageously improved, but the hot-offset resistance and the heat-resistant preservability is adversely affected. Meanwhile, with an appropriate amount of the 1,4-cyclohexylene skeleton, the weight-average molecular weight of the resin can be adjusted while Tg is maintained. Accordingly, the low-temperature fixability can be further improved.

Therefore, the ranges of the molar ratio (benzene ring skeleton/1,4-cyclohexylene skeleton) and the molar ratio (benzene skeleton/double-end ester-bond alkylene skeleton) are specified as described above. If the molar ratio (benzene ring skeleton/1,4-cyclohexylene skeleton) is lower than 2.0, the polyester resin becomes brittle, and the toner loses its durability. If the molar ratio (benzene ring skeleton/1,4-cyclohexylene skeleton) is higher than 15.0, it becomes difficult to reduce the molecular weight while maintaining the glass transition temperature, and therefore, low-temperature fixability cannot be achieved. Further, if the molar ratio (benzene skeleton/double-end ester-bond alkylene skeleton) is lower than 3.0, it is difficult to maintain heat-resistant preservability.

The molar ratio (benzene ring skeleton/1,4-cyclohexylene skeleton) and the molar ratio (benzene skeleton/double-end ester-bond alkylene skeleton) can be calculated from the raw-material composition ratio between polyprotic carboxylic acid and polyhydric alcohol, which are the raw materials of the resin. Alternatively, these molar ratios can be calculated by carrying out 1H-NMR (nuclear magnetic resonance) measurement on the generated resin.

So as to maintain heat-resistant preservability as well as low-temperature fixability and hot-offset resistance, it is critical to adjust the weight-average molecular weight (Mw) of the polyester resin, and Mw of the THF soluble portion of the polyester resin is preferably set at 2,000 to 7,800 in the present invention. If Mw is less than 2,000, the oligomer component increases. Therefore, even if the chemical structure is controlled as described above, the heat-resistant preservability is degraded. If Mw exceeds 7,800, the melting temperature becomes higher, and the low-temperature fixability is degraded.

The toner characteristics such as low-temperature fixability, hot-offset resistance, heat-resistant preservability, and charging stability can also be improved by adjusting the acid value of the polyester resin to 1.0 to 50.0 KOHmg/g.

The low-temperature fixing toner of this embodiment can be manufactured by using the above described polyester resin as the binder resin, and mixing therein a polymer (hereinafter referred to as the "prepolymer") having parts that are reactive with a compound containing active hydrogen groups as described later in detail. As this prepolymer is mixed with a compound containing active hydrogen groups, elongation or a cross-linking reaction can be caused during the toner manufacturing process, and the above toner characteristics can be improved.

If the acid value of the polyester resin exceeds 50.0 KOHmg/g, the elongation or the cross-linking reaction of the prepolymer becomes insufficient, and the hot-offset resistance is adversely affected. If the acid value is smaller than 1.0 KOHmg/g, the elongation or the cross-linking reaction of the prepolymer is easily facilitated, and a problem is caused in production stability.

The acid value of the polyester resin is measured by a method compliant with JIS K0070. However, if a sample is not dissolved, dioxane or THF is used as the solvent, for example. Further study indicates that not only the acid value of the polyester resin but also the acid value of the toner is critical in maintaining low-temperature fixability and hot-offset resistance. The acid value of the toner is preferably 0.5 to 40.0 KOHmg/g. If the acid value of the toner exceeds 40.0 KOHmg/g, the elongation or the cross-linking reaction of the prepolymer becomes insufficient, and the hot-offset resistance is adversely affected. If the acid value is smaller than 0.5 KOHmg/g, the elongation or the cross-linking reaction of the prepolymer is easily facilitated, and a problem is caused in production stability. The acid value of the toner can be measured in the same manner as the measurement of the acid value of the polyester resin.

So as to achieve low-temperature fixability, heat-resistant preservability, and high durability, the glass transition temperature of the toner is preferably 40 to 60° C. If the glass transition temperature is lower than 40° C., toner blocking in the developing machine or filming on the photoconductor easily occurs. If the glass transition temperature exceeds 60° C., the low-temperature fixability is easily degraded. The glass transition temperature of the toner can be measured in the same manner as the measurement of the glass transition temperature of the polyester resin.

In the low-temperature fixing toner of this embodiment, the volume-average particle diameter (Dv) of the toner is preferably 3 to 8 μm, and more preferably, the ratio (Dv/Dn) of the volume-average particle diameter (Dv) to the number-average particle diameter (Dn) is in a range of 1.00 to 1.25. As Dv/Dn is specified in this manner, a toner having high resolution and high image quality can be obtained. So as to obtain an image with even higher quality, Dv is preferably set at 3 to 7 μm, Dv/Dn is preferably set at 1.00 to 1.20, and the number of particles of 3 μm or smaller is preferably set at 1 to 10 in percentage. More preferably, Dv is set at 3 to 6 μm, and Dv/Dn is set at 1.00 to 1.15. Such a toner excels in heat-resistant preservability, low-temperature fixability, and hot-offset resistance. Particularly, such a toner excels in image glossiness when used in a full-color copying machine or the like. Further, in a two-component developer, even if the toner is supplied and consumed over a long period of time, variations in the particle diameter of the toner in the developer become smaller. Even if the toner is stirred in the developing device over a long period of time, preferred stable developing properties can be achieved.

The average particle size and the granularity distribution of the toner were measured with a Coulter counter Type TA-II, to which an interface that outputs a number distribution and a volume distribution (manufactured by the Institute of Japanese Union of Scientists & Engineers) and a PC9801 personal computer (manufactured by NEC Corporation) were connected.

Example preparations of low-temperature fixing toners of this embodiment are now described.

Example Preparation 1

Example Preparation of Polyester Resin

Into a reaction vessel equipped with a condenser tube, a mixer, and a nitrogen introduction tube, 517 parts of bisphenol-A ethylene oxide two-molar adduct, 317 parts of terephthalic acid, 101 parts of ethylene glycol, and 65 parts of hydrogenated bisphenol A are introduced. In a normal-pressure nitrogen gas stream, a condensation reaction was conducted at 170° C. for 10 hours, and the condensation reaction was continued at a reaction temperature of 210° C. for five hours. After the reaction was further continued for five hours while dehydration was conducted at a reduced pressure of 0 to 15 mmHg, cooling was conducted, to obtain a polyester resin (PE1). Of the obtained polyester resin (PE1), the weight-average molecular weight (Mw) of the THF soluble portion was 2,900, the acid value was 5 KOHmg/g, and the glass transition temperature (Tg) was 43° C. The ratio (Mw/Tg) between the weight-average molecular weight and the glass transition temperature was 67. The molar ratio between the benzene ring skeleton and the 1,4-cyclohexylene skeleton was 9.5, and the molar ratio between the benzene ring skeleton and double-end ester-bond alkylene skeleton was 3.2.

Example Preparation of Prepolymer

Into a reaction vessel equipped with a condenser tube, a mixer, and a nitrogen introduction tube, 795 parts of bisphenol-A ethylene oxide two-molar adduct, 200 parts of isophthalic acid, 65 parts of terephthalic acid, and two parts of dibutyltin oxide were introduced. A condensation reaction was then conducted in a normal-pressure nitrogen gas stream at 210° C. for eight hours. After the reaction was continued for five hours while dehydration was conducted at a reduced pressure of 10 to 15 mmHg, cooling to 80° C. was performed, and a reaction with 170 parts of isophorone diisocyanate was conducted in ethyl acetate for two hours, to obtain a prepolymer (a1). Of the obtained prepolymer (a1), the weight-average molecular weight (Mw) of the THF soluble portion was 5,000, and the average number of functional groups was 2.25.

Example Preparation of Ketimine Compound

Into a reaction vessel equipped with a mixing stick and a thermometer, 30 parts of isophorodiamine and 70 parts of methyl ethyl ketone were introduced. A reaction was then conducted at 50° C. for five hours, to obtain a ketimine compound (b1).

Example Preparation of Toner

Eighty-five parts of the polyester (PE1), 15 parts of the prepolymer (a1), two parts of the ketimine compound (b1), five parts of desolated-fatty-acid-type carnauba wax, 10 parts of carbon black (#44, manufactured by Mitsubishi Chemical Corporation), one part of metal-containing azo compound, and five parts of water were mixed and stirred with a Henschel mixer. The resultant material was then heated and dissolved with a roll mill at a temperature of 130 to 140° C. for approximately 30 minutes. After cooled to room temperature, the resultant kneaded material was pulverized and classified with a jet mill and a pneumatic classification apparatus, to obtain a toner matrix. With the obtained toner matrix, 0.5 parts of hydrophobic silica was additionally mixed, and a toner (I) was completed.

Example Preparation 2

Example Preparation of Polyester Resin

Into a reaction vessel equipped with a condenser tube, a mixer, and a nitrogen introduction tube, 613 parts of bisphenol-A ethylene oxide two-molar adduct, 322 parts of terephthalic acid, 13 parts of ethylene glycol, and 52 parts of hydrogenated bisphenol A are introduced. A polyester resin (PE2) was then obtained in the same manner as in Example Preparation 1. Of the obtained polyester resin (PE2), the weight-average molecular weight (Mw) of the THF soluble portion was 5,800, the acid value was 38 KOHmg/g, and the glass transition temperature (Tg) was 59° C. The ratio (Mw/Tg) between the weight-average molecular weight and the glass transition temperature was 98. The molar ratio between the benzene ring skeleton and the 1,4-cyclohexylene skeleton was 13.5, and the molar ratio between the benzene ring skeleton and double-end ester-bond alkylene skeleton was 27.0.

Example Preparation of Toner

Eighty-five parts of the polyester resin (PE2), 15 parts of the prepolymer (a1), two parts of the ketimine compound (b1), five parts of desolated-fatty-acid-type carnauba wax, 10 parts of carbon black (#44, manufactured by Mitsubishi Chemical Corporation), one part of metal-containing azo compound, and five parts of water were mixed and stirred with a Henschel mixer. The resultant material was then heated and dissolved with a roll mill at a temperature of 130 to 140° C. for approximately 30 minutes. After cooled to room temperature, the resultant kneaded material was pulverized and classified with a jet mill and a pneumatic classification apparatus, to obtain a toner matrix. With the obtained toner matrix, 0.5 parts of hydrophobic silica was additionally mixed, and a toner (II) was completed.

Example Preparation 3

Example Preparation of Polyester Resin

Into a reaction vessel equipped with a condenser tube, a mixer, and a nitrogen introduction tube, 548 parts of bisphenol-A ethylene oxide two-molar adduct, 296 parts of terephthalic acid, 44 parts of ethylene glycol, and 113 parts of hydrogenated bisphenol A are introduced. A polyester resin (PE3) was then obtained in the same manner as in Example Preparation 1. Of the obtained polyester resin (PE3), the weight-average molecular weight (Mw) of the THF soluble portion was 3,300, the acid value was 7 KOHmg/g, and the glass transition temperature (Tg) was 43° C. The ratio (Mw/Tg) between the weight-average molecular weight and the glass transition temperature was 77. The molar ratio between the benzene ring skeleton and the 1,4-cyclohexylene skeleton was 5.6, and the molar ratio between the benzene ring skeleton and double-end ester-bond alkylene skeleton was 7.5.

Example Preparation of Toner

Eighty-three parts of the polyester resin (PE3), 17 parts of the prepolymer (a1), two parts of the ketimine compound (b1), five parts of desolated-fatty-acid-type carnauba wax, 10 parts of carbon black (#44, manufactured by Mitsubishi Chemical Corporation), one part of metal-containing azo compound, and five parts of water were mixed and stirred with a Henschel mixer. The resultant material was then heated and dissolved with a roll mill at a temperature of 130 to 140° C. for approximately 30 minutes. After cooled to room temperature, the resultant kneaded material was pulverized and classified with a jet mill and a pneumatic classification apparatus, to obtain a toner matrix. With the obtained toner matrix, 0.5 parts of hydrophobic silica was additionally mixed, and a toner (III) was completed.

Example Preparation 4

Example Preparation of Polyester Resin

Into a reaction vessel equipped with a condenser tube, a mixer, and a nitrogen introduction tube, 426 parts of bisphenol-A ethylene oxide two-molar adduct, 350 parts of terephthalic acid, eight parts of ethylene glycol, and 216 parts of hydrogenated bisphenol A are introduced. A polyester resin (PE4) was then obtained in the same manner as in Example Preparation 1. Of the obtained polyester resin (PE4), the weight-average molecular weight (Mw) of the THF soluble portion was 6,500, the acid value was 28 KOHmg/g, and the glass transition temperature (Tg) was 62° C. The ratio (Mw/Tg) between the weight-average molecular weight and the glass transition temperature was 105. The molar ratio between the benzene ring skeleton and the 1,4-cyclohexylene skeleton was 2.7, and the molar ratio between the benzene ring skeleton and double-end ester-bond alkylene skeleton was 35.7.

Example Preparation of Prepolymer

Into a reaction vessel equipped with a condenser tube, a mixer, and a nitrogen introduction tube, 795 parts of bisphenol-A ethylene oxide two-molar adduct, 200 parts of isophthalic acid, 65 parts of terephthalic acid, and two parts of dibutyltin oxide were introduced. In a normal-pressure nitrogen gas stream, a condensation reaction was then conducted at 210° C. for eight hours. After the reaction was continued for five hours while dehydration was conducted at a reduced pressure of 10 to 15 mmHg, cooling to 80° C. was performed, and a reaction with 150 parts of isophorone diisocyanate was conducted in ethyl acetate for two hours, to obtain a prepolymer (a2). Of the obtained prepolymer (a2), the weight-average molecular weight (Mw) of the THF soluble portion was 5,000, and the average number of functional groups was 2.00.

Example Preparation of Toner

Into a beaker, 14.3 parts of the prepolymer (a2), 55 parts of the polyester resin (PE4), and 78.6 parts of ethyl acetate were introduced, and these materials were stirred and dissolved. Into a bead mill, 10 parts of rice bran wax as a release agent, four parts of copper phthalocyanine blue pigment, and 100 parts of ethyl acetate were introduced. These materials were then dispersed for 30 minutes. The two solutions were mixed, and were stirred with a TK homomixer at 12,000 rpm for five minutes. After that, the mixture was subjected to a dispersion treatment with a bead mill for ten minutes. The resultant material is a toner material oil dispersion liquid (1).

Into a beaker, 306 parts of ion exchanged water, 265 parts of tricalcium phosphate 10% suspension, and 0.2 parts of sodium dodecylbenzenesulfonate are introduced. While being stirred with a TK homomixer at 12,000 rpm, the toner material oil dispersion liquid (1) and 2.7 parts of the ketimine compound (b1) were added to the aqueous dispersion liquid. A reaction was then conducted while the stirring was continued for 30 minutes. The organic solvent was removed, within one hour, from the reacted dispersion liquid (viscosity: 5,500 mPa·s) at a reduced pressure and a temperature of 50° C. or lower. After that, filtration, washing, drying, and pneumatic classification were performed, to obtain a spherical toner matrix.

Into a Q mixer (manufactured by Mitsui Mining Co., Ltd.), 100 parts of the obtained matrix particles and 0.25 parts of charge control agent (BONTRON E-84, manufactured by Orient Chemical Industries Co., Ltd.) were introduced. The circumferential speed of a turbine blade was set at 50 msec, and mixing was performed. In this case, the mixing operation was performed in five cycles of a two-minute operation and a one-minute interval, and the total processing time was 10 minutes. Further, 0.5 parts of hydrophobic silica (H2000, manufactured by Clamant (Japan) K.K.) was added, and mixing was performed. In this case, the mixing operation was performed in five cycles of 30-second mixing and a one-minute interval at a circumferential speed of 15 msec. As a result, a toner (IV) was completed.

The physical properties related to the polyester resins (PE1) through (PE4) used in the toners (I) through (IV) are shown below in Table 8.

TABLE 8

| Polyester resin | Weight-average molecular weight [Mw] | Acid value [KOHmg/g] | Glass transition temperature (Tg) [° C.] | Mw/Tg | Benzene ring skeleton/ 1,4-cyclohexylene skeleton | Benzene ring skeleton/ double-end ester-bond alkylene skeleton |
|---|---|---|---|---|---|---|
| PE1 | 2,900 | 5 | 43 | 67 | 9.5 | 3.2 |
| PE2 | 5,800 | 38 | 59 | 98 | 13.5 | 27.0 |
| PE3 | 3,300 | 7 | 43 | 77 | 5.6 | 7.5 |
| PE4 | 6,500 | 23 | 62 | 105 | 2.7 | 35.7 |

Example Preparation 5

Example Preparation of Polyester Resin Into a reaction vessel equipped with a condenser tube, a mixer, and a nitrogen introduction tube, 585 parts of bisphenol-A ethylene oxide two-molar adduct, 307 parts of terephthalic acid, 71 parts of ethylene glycol, and 36 parts of hydrogenated bisphenol A are introduced. A polyester resin (PE5) was then obtained in the same manner as in Example Preparation 1. Of the obtained polyester resin (PE5), the weight-average molecular weight (Mw) of the THF soluble portion was 2,500, the acid value was 9 KOHmg/g, and the glass transition temperature (Tg) was 35° C. The ratio (Mw/Tg) between the weight-average molecular weight and the glass transition temperature was 71. The molar ratio between the benzene ring skeleton and the 1,4-cyclohexylene skeleton was 18.5, and the molar ratio between the benzene ring skeleton and double-end ester-bond alkylene skeleton was 4.8.

Example Preparation of Toner

Eighty-five parts of the polyester resin (PE5), 15 parts of the prepolymer (a1), two parts of the ketimine compound (b1), five parts of desolated-fatty-acid-type carnauba wax, 10 parts of carbon black (#44, manufactured by Mitsubishi Chemical Corporation), one part of metal-containing azo compound, and five parts of water were mixed and stirred with a Henschel mixer. The resultant material was then heated and dissolved with a roll mill at a temperature of 130 to 140° C. for approximately 30 minutes. After cooled to room temperature, the resultant kneaded material was pulverized and classified with a jet mill and a pneumatic classification apparatus, to obtain a toner matrix. With the obtained toner matrix, 0.5 parts of hydrophobic silica was additionally mixed, and a toner (V) was completed.

Example Preparation 6

Example Preparation of Polyester Resin

Into a reaction vessel equipped with a condenser tube, a mixer, and a nitrogen introduction tube, 244 parts of bisphenol-A ethylene oxide two-molar adduct, 443 parts of terephthalic acid, 99 parts of ethylene glycol, and 214 parts of hydrogenated bisphenol A are introduced. A polyester resin (PE6) was then obtained in the same manner as in Example Preparation 1. Of the obtained polyester resin (PE6), the weight-average molecular weight (Mw) of the THF soluble portion was 5,700, the acid value was 18 KOHmg/g, and the glass transition temperature (Tg) was 45° C. The ratio (Mw/Tg) between the weight-average molecular weight and the glass transition temperature was 127. The molar ratio between the benzene ring skeleton and the 1,4-cyclohexylene skeleton was 2.4, and the molar ratio between the benzene ring skeleton and double-end ester-bond alkylene skeleton was 2.6.

Example Preparation of Toner

Into a beaker, 14.3 parts of the prepolymer (a1), 55 parts of the polyester resin (PE6), and 78.6 parts of ethyl acetate were introduced, and these materials were stirred and dissolved. Into a bead mill, 10 parts of rice bran wax as a release agent, four parts of copper phthalocyanine blue pigment, and 100 parts of ethyl acetate were introduced. These materials were then dispersed for 30 minutes. The two solutions were mixed, and were stirred with a TK homomixer at 12,000 rpm for five minutes. After that, the mixture was subjected to a dispersion treatment with a bead mill for ten minutes. The resultant material is a toner material oil dispersion liquid (2).

Into a beaker, 306 parts of ion exchanged water, 265 parts of tricalcium phosphate 10% suspension, and 0.2 parts of sodium dodecylbenzenesulfonate are introduced. While being stirred with a TK homomixer at 12,000 rpm, the toner material oil dispersion liquid (2) and 2.7 parts of the ketimine compound (b1) were added to the aqueous dispersion liquid. A reaction was then conducted while the stirring was continued for 30 minutes. The organic solvent was removed, within one hour, from the reacted dispersion liquid (viscosity: 3,800 mPa·s) at a reduced pressure and a temperature of 50° C. or lower. After that, filtration, washing, drying, and pneumatic classification were performed, to obtain a spherical toner matrix.

Into a Q mixer (manufactured by Mitsui Mining Co., Ltd.), 100 parts of the obtained matrix particles and 0.25 parts of charge control agent (BONTRON E-84, manufactured by Orient Chemical Industries Co., Ltd.) were introduced. The circumferential speed of a turbine blade was set at 50 msec, and mixing was performed. In this case, the mixing operation was performed in five cycles of a two-minute operation and a one-minute interval, and the total processing time was 10 minutes. Further, 0.5 parts of hydrophobic silica (H2000, manufactured by Clariant (Japan) K.K.) was added, and mixing was performed. In this case, the mixing operation was performed in five cycles of 30-second mixing and a one-minute interval at a circumferential speed of 15 msec. As a result, a toner (VI) was completed.

Example Preparation 7

Example Preparation of Polyester Resin Into a reaction vessel equipped with a condenser tube, a mixer, and a nitrogen introduction tube, 393 parts of bisphenol-A ethylene oxide two-molar adduct, 430 parts of terephthalic acid, 121 parts of ethylene glycol, and 57 parts of hydrogenated bisphenol A are introduced. A polyester resin (PE7) was then obtained in the same manner as in Example Preparation 1.

Of the obtained polyester resin (PE7), the weight-average molecular weight (Mw) of the THF soluble portion was 5,000, the acid value was 11 KOHmg/g, and the glass transition temperature (Tg) was 41° C. The ratio (Mw/Tg) between the weight-average molecular weight and the glass transition temperature was 122. The molar ratio between the benzene ring skeleton and the 1,4-cyclohexylene skeleton was 10.8, and the molar ratio between the benzene ring skeleton and double-end ester-bond alkylene skeleton was 2.6.

Example Preparation of Toner

Into a beaker, 14.3 parts of the prepolymer (a2), 55 parts of the polyester resin (PE7), and 78.6 parts of ethyl acetate were introduced, and these materials were stirred and dissolved. Into a bead mill, 10 parts of rice bran wax as a release agent, four parts of copper phthalocyanine blue pigment, and 100 parts of ethyl acetate were introduced. These materials were then dispersed for 30 minutes. The two solutions were mixed, and were stirred with a TK homomixer at 12,000 rpm for five minutes. After that, the mixture was subjected to a dispersion treatment with a bead mill for ten minutes. The resultant material is a toner material oil dispersion liquid (3).

Into a beaker, 306 parts of ion exchanged water, 265 parts of tricalcium phosphate 10% suspension, and 0.2 parts of sodium dodecylbenzenesulfonate are introduced. While being stirred with a TK homomixer at 12,000 rpm, the toner material oil dispersion liquid (3) and 2.7 parts of the ketimine compound (b1) were added to the aqueous dispersion liquid. A reaction was then conducted while the stirring was continued for 30 minutes. The organic solvent was removed, within one hour, from the reacted dispersion liquid (viscosity: 7,800 mPa·s) at a reduced pressure and a temperature of 50° C. or lower. After that, filtration, washing, drying, and pneumatic classification were performed, to obtain a spherical toner matrix.

Into a Q mixer (manufactured by Mitsui Mining Co., Ltd.), 100 parts of the obtained matrix particles and 0.25 parts of charge control agent (BONTRON E-84, manufactured by Orient Chemical Industries Co., Ltd.) were introduced. The circumferential speed of a turbine blade was set at 50 msec, and mixing was performed. In this case, the mixing operation was performed in five cycles of a two-minute operation and a one-minute interval, and the total processing time was 10 minutes. Further, 0.5 parts of hydrophobic silica (H2000, manufactured by Clariant (Japan) K.K.) was added, and mixing was performed. In this case, the mixing operation was performed in five cycles of 30-second mixing and a one-minute interval at a circumferential speed of 15 msec. As a result, a toner (VII) was completed.

The physical properties related to the polyester resins (PE5) through (PE7) used in the toners (V) through (VII) are shown below in Table 9.

TABLE 9

| Polyester resin | Weight-average molecular weight [Mw] | Acid value [KOHmg/g] | Glass transition temperature (Tg) [° C.] | Mw/Tg | Benzene ring skeleton/ 1,4-cyclohexylene skeleton | Benzene ring skeleton/ double-end ester-bond alkylene skeleton |
|---|---|---|---|---|---|---|
| PE5 | 2,500 | 9 | 35 | 71 | 18.5 | 4.8 |
| PE6 | 5,700 | 18 | 45 | 127 | 2.4 | 2.6 |
| PE7 | 5,000 | 11 | 41 | 122 | 10.8 | 2.6 |

As for the above described toners (I) through (VII) as examples of low-temperature fixing toners of this embodiment, low-temperature fixability, high-temperature offset resistance, and heat-resistant preservability was evaluated. The evaluated items of the toners, and the evaluation method are as follows.

Fixing Property Evaluation

A paper sheet Type 6200, manufactured by Ricoh Company, Ltd., was set on an apparatus produced by modifying the fixing unit of a copying machine MF2200, manufactured by Ricoh Company, Ltd., which used a fixing roller made of Teflon (a registered trade name). Copying tests were then conducted. The fixing temperature was varied, to determine a cold offset temperature (the lower fixing temperature limit) and a hod offset temperature (a hot-offset-resistant temperature). The lower fixing temperature limit of a conventional low-temperature fixing toner is approximately 140 to 150° C. The conditions under which low-temperature fixability was evaluated are as follows. The linear velocity of paper sheet feeding is 120 to 150 mm/sec, the surface pressure was 1.2 kgf/cm$^2$, and the nip width was 3 mm. As for the conditions in which hot offset was evaluated, the linear velocity of paper sheet feeding was 50 mm/sec, the surface pressure was 2.0 kgf/cm$^2$, and the nip width was 4.5 mm.

The criteria for evaluation on the respective properties are as follows.

1) Low-Temperature Fixability (Five Levels)

A: lower than 130° C.

B: 130 to 140° C.

C: 140 to 150° C.

D: 150 to 160° C.

E: 160° C. or higher

2) Hot-Offset Resistance (Five Levels)

A: 201° C. or higher

B: 200 to 191° C.

C: 190 to 181° C.

D: 180 to 171° C.

E: 170° C. or lower

Heat-Resistant Conservation Property Evaluation

Twenty grams of each toner sample was put into a 20-ml glass bottle, and the glass bottle was tapped approximately 50 times, to tightly gather the sample. The sample was then put into a high-temperature vessel at 50° C., and was left there for 24 hours. After that, a penetrometer was used to determine a degree of penetration as follows.

3) Heat-Resistant Preservability (Five Levels)

A: complete penetration

B: up to 25 mm

C: 25 to 20 mm

D: 20 to 15 mm

E: 15 mm or shorter

The results of the toner evaluations are shown below in Table 10.

TABLE 10

| Toner | Acid value [KOHmg/g] | Glass transition temperature (Tg) [° C.] | Volume-average particle diameter (Dr) [μm] | Dv/Dn | Average circularity | RET specific surface area [m$^2$/g] | Low-temperature fixability | Hot offset resistance | Heat-resistant preservability |
|---|---|---|---|---|---|---|---|---|---|
| I | 4 | 45 | 6.7 | 1.05 | 0.92 | 5.9 | A | A | B |
| II | 28 | 59 | 5.9 | 1.10 | 0.93 | 5.2 | B | B | A |
| III | 6 | 43 | 7.0 | 1.07 | 0.98 | 5.3 | A | A | B |
| IV | 23 | 61 | 4.7 | 1.15 | 0.98 | 1.5 | B | B | A |
| V | 8 | 38 | 5.5 | 1.08 | 0.83 | 5.5 | A | B | E |
| VI | 16 | 46 | 5.8 | 1.10 | 0.96 | 5.0 | B | A | C |
| VII | 10 | 43 | 3.2 | 1.22 | 0.98 | 1.9 | B | B | D |

As can be seen from Table 9, the toners (I) through (IV), (VI), and (VII) having glass transition temperatures (Tg) between 40° C. and 61° C. achieved excellent low-temperature fixability, high hot-offset resistances, and excellent heat-resistant preservability. However, the toner (V) having a lower glass transition temperature (Tg) than 40° C. was excellent in low-temperature fixability and hot-offset resistance, but was poor in heat-resistant preservability, as indicated by "E" in the column of heat-resistant preservability. This confirmed that a toner having a glass transition temperature (Tg) between 40° C. and 60° C. excels in low-temperature fixability, high hot-offset resistance, and heat-resistant preservability.

The above described embodiment is merely an example, and the present invention exhibits a unique effect in each of the following modes.

(Mode A)

A cleaning blade 1400 is formed with a blade member 1401 having a stack structure of elastic materials having different degrees of hardness from each other, the edge line portion 1403 of the blade member 1401 being brought into contact with the surface of a cleaning target member such as a photoconductor 10 performing surface movement, the blade member 1401 removing adhering matter from the surface of the photoconductor 10. In this cleaning blade 1400, the cleaning layer including the edge line portion 1403 is impregnated with a resin or is made of an elastic material having a high degree of hardness, and the permanent elongation rate of the entire blade member is set at 3.0% or lower.

As mentioned above in the description of the embodiment, so as to increase the hardness of the edge line portion by impregnating the edge line portion with a resin in a single-layer blade member, it is necessary to use an elastic material that has a low permanent elongation rate and a relatively low degree of hardness. In a case where an elastic material having a low degree of hardness is used as the base material and the hardness of the edge line portion through an impregnation treatment is increased, the amount of impregnation needs to be made larger than that in a case where an elastic material having a high degree of hardness is used as the base material. Therefore, the impregnation time needs to be made longer, or the concentration of the impregnating coating solution needs to be made higher. This results in an increase in cost due to the elongated production time, or an increase in the cost of the impregnating coating solution due to the increased concentration of the impregnating coating solution. In view of this, elastic members made of elastic materials having different degrees of hardness from each other are bonded to each other, the edge layer 1401*a* in contact with the cleaning target member is made of an elastic material having a high degree of hardness, and the cleaning layer including the edge line portion 1403 is subjected to the impregnation treatment in this embodiment. A blade member having a double-layer stack structure that can be formed in a shorter period of time than the impregnation treatment for an elastic material having a low degree of hardness is used. So as to achieve a higher degree of hardness, the cleaning layer including the edge line portion 1403 is impregnated with a resin or is made of an elastic material having a high degree of hardness. Also, the permanent elongation rates of the edge layer 1401*a*, the backup layer 1401*b*, and the edge line portion 1403 are combined, so that the permanent elongation rate of the entire blade member is set at 3.0% or lower. As can be seen from the above described verification experiments, the deformation of the edge line portion 1403 brought into contact with the photoconductor 10 is small, an increase in the contact area can be prevented, and the contact pressure can be increased. Further, permanent deformation over time can be effectively reduced.

This is supposedly because the backup layer 1401*b* bonded to the edge layer 1401*a* in contact with the photoconductor 10 has a lower degree of hardness and a lower permanent elongation rate than the edge layer 1401*a* and the edge line portion 1403, and accordingly, permanent deformation over time is reduced in the entire blade member. As the permanent elongation rate of the entire blade member is set at 3.0% or lower, permanent deformation can be made smaller than that in the cleaning blade disclosed in Patent Document 1, even if the blade member 1401 stays in contact with the photoconductor 10 over a long period of time. Accordingly, the initial contact state can be maintained. This is also supposedly because the cleaning layer including the edge line portion 1403 of the blade member 1401 is subjected to the impregnation treatment to obtain a higher degree of hardness, or the cleaning layer is made of an elastic material having a high degree of hardness, so that the degree of hardness of the edge line portion 1403 is made higher than those of the edge layer 1401*a* and the backup layer 1401*b*, and the contact pressure can be set at a high value. Accordingly, when the edge line portion 1403 is brought into contact with the photoconductor 10, the deformation of the edge line portion 1403 is small, an increase of the contact area can be prevented, and cleaning performance can be improved.

(Mode B)

In (Mode A), the blade member 1401 includes: the cleaning layer such as an impregnated portion 1405 including the edge line portion 1403; the edge layer 1401*a* having a surface facing the surface of the photoconductor 10; and the backup layer 1401*b* having a non-photoconductor-facing surface opposite to the photoconductor-facing surface 1404, and the degrees of hardness of the elastic materials of the impregnated portion 1405, the edge layer 1401*a*, and the backup layer 1401*b* differ from one another.

According to this, a blade member is formed with a double-layer stack structure including at least an edge layer and a backup layer, and the edge line portion 1403 is made to have a higher degree of hardness through an impregnation treatment as described above in an example of the embodiment. In this aspect, this blade member differs from a single-layer blade member in which the edge line portion is made to have a higher degree of hardness through an impregnation treatment. Accordingly, an increase in cost due to a prolonged production time or an increase in cost of the impregnating coating solution due to an increase in the concentration of the impregnating coating solution, and permanent deformation over time can be prevented. At the same time, excellent cleaning performance can be maintained over a long period of time.

(Mode C)

In (Mode A) or (Mode B), the Young's modulus of the elastic material of the impregnated portion 1405 is higher than those of the edge layer 1401*a* and the backup layer 1401*b*.

According to this, the Young's modulus of the impregnated portion 1405 including the edge line portion 1403 is made higher than those of the edge layer 1401*a* and the backup layer 1401*b*, and accordingly, the contact pressure with which the edge line portion 1403 is to be brought into contact with the image bearer can be set at a high value, as described above in an example of the embodiment.

(Mode D)

In (Mode A) through (Mode C), the Young's modulus of the elastic material of the impregnated portion 1405 is higher than that of the edge layer 1401*a*, and the Young's modulus of the elastic material of the edge layer 1401*a* is higher than that of the backup layer 1401*b*.

According to this, the Young's modulus of the edge line portion 1403 is made higher than those of the edge layer 1401*a* and the backup layer 1401*b*, and accordingly, the contact pressure can be set at a high value, as described above in an example of the embodiment. As the backup layer 1401*b* has a lower Young's modulus and a lower permanent elongation rate than those of the edge layer 1401*a*, permanent deformation over time can be reduced in the entire blade member. Accordingly, even if the blade member 1401 is kept in contact with the photoconductor 10 over a long period of time, permanent deformation does not easily occur, and the initial contact state can be maintained.

(Mode E)

In (Mode A) through (Mode D), the elastic power of the portion in the vicinity of the edge line portion of the cleaning layer is 40% or higher.

According to this, defective cleaning and local wear due to plastic deformation can be prevented even in a low-temperature environment, as described above in an example of the embodiment.

(Mode F)

In any of (Mode A) through (Mode E), at the edge line portion 1403, a cross-linked structure is formed with an ultraviolet curable resin containing at least an acrylate or methacrylate having a tricyclodecane or adamantane skeleton.

According to this, the toner removal performance is greatly improved, the wear of the cleaning blade is reduced, and excellent cleaning performance can be maintained over a long period of time, as mentioned above in the description of the embodiment. Also, the coefficient of friction between the cleaning blade and the photoconductor is reduced, and the wear of the photoconductor is reduced. Accordingly, the life of the photoconductor and the life of the image forming apparatus can be prolonged. Further, as the cleaning blade does not rub the toner additive or the like against the surface of the photoconductor, any abnormal image with blanks is not generated.

(Mode G)

In (Mode F), the number of functional groups of the acrylate or methacrylate having a tricyclodecane or adamantane skeleton is one to six.

According to this, the hardness of the edge line portion of the blade member can be further increased. Accordingly, too large deformation of the edge line portion of the blade member can be prevented, the contact pressure can be made higher, and permanent deformation can be reduced. At the same time, excellent cleaning performance can be maintained over a long period of time, as mentioned above in the description of the embodiment.

(Mode H)

In (Mode F) or (Mode G), the acrylate or methacrylate having the tricyclodecane or adamantane skeleton has a molecular weight of 500 or smaller.

According to this, the molecular weight of the acrylate or methacrylate having the tricyclodecane or adamantane skeleton is 500 or smaller. Accordingly, the molecular size becomes smaller, and impregnating the cleaning blade becomes easier, facilitating an increase in hardness, as mentioned above in the description of the embodiment.

(Mode I)

In any of (Mode F) through (Mode H), an acrylate monomer having the molecular weight of 100 to 1500 is mixed with the acrylate or methacrylate having a tricyclodecane or adamantane skeleton.

According to this, an acrylate monomer having a molecular weight of 100 to 1500 is mixed with the acrylate or methacrylate having the tricyclodecane or adamantane skeleton, so that the blade member can be impregnated with a resin by brush coating, spray coating, dip coating, or the like, as mentioned above in the description of the embodiment.

(Mode J)

An image forming apparatus includes: an image bearer such as a photoconductor 10; and a cleaning member that is in contact with the surface of the image bearer to remove adhering matter adhering to the surface of the image bearer. In this image forming apparatus, an image formed on the image bearer is eventually transferred onto a recording medium, and the cleaning blade of any of (Mode A) through (Mode I) is used as the cleaning member.

According to this, the image bearer can be properly cleaned over a long period of time, and excellent image formation can be performed, as mentioned above in the description of the embodiment.

(Mode K)

A process cartridge 121 that is detachably attached to an image forming apparatus includes: an image bearer such as a photoconductor 10; and a cleaning member that is in contact with the surface of the image bearer to remove adhering matter adhering to the surface of the image bearer. In this process cartridge 121, the cleaning blade of any of (Mode A) through (Mode I) is used as the cleaning member.

According to this, cleaning performance can be improved while permanent deformation of the blade member over time is reduced, as mentioned above in the description of the embodiment. Also, with the form of a process cartridge, higher operability can be achieved.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

REFERENCE SIGNS LIST

1 Cleaning device
5 Cleaning blade
10 Photoconductor
100 Printer
120 Image forming unit
121 Process cartridge
130 Sheet feeding unit
160 Intermediate transfer device
1400 Cleaning blade
1401 Blade member
1401*a* Edge layer
1401*b* Backup layer
1402 Supporting member
1403 Edge line portion
1404 Photoconductor-facing surface
1405 Impregnated portion
1500 Cleaning blade
1501 Blade member
1502 Supporting member
1503 Edge line portion
1504 Photoconductor-facing surface
1505 Impregnated portion
1600 Cleaning blade
1601 Blade member
1601*a* Edge layer
1601*b* Backup layer
1602 Supporting member
1603 Edge line portion
1604 Photoconductor-facing surface
1605 Impregnated portion
1700 Cleaning blade
1701 Blade member
1701*a* Edge layer
1701*b* Backup layer
1702 Supporting member
1703 Edge line portion
1704 Photoconductor-facing surface
1705 Impregnated portion
1800 Cleaning blade
1801 Blade member
1801*a* Edge layer
1801*b* Backup layer
1802 Supporting member
1803 Edge line portion
1804 Photoconductor-facing surface
1805 Impregnated portion
1900 Cleaning blade
1901 Blade member
1901*a* Edge layer
1901*b* Backup layer
1902 Supporting member
1903 Edge line portion
1904 Photoconductor-facing surface
1905 Impregnated portion

CITATION LIST

Patent Literature

PTL 1: Japanese Laid-open Patent Publication No. 2014-066767

The invention claimed is:

1. A cleaning blade comprising:

an edge layer including an edge line portion to contact a surface of a cleaning target performing surface movement to remove adhering matter from the surface of the cleaning target; and a backup layer formed with elastic materials having different degrees of hardness from the edge layer, wherein the edge layer is impregnated with a resin or is made of an elastic material having a higher degree of hardness than the backup layer, a permanent elongation rate of the entire blade including the edge layer and the backup layer is set at 3.0% or lower, wherein the edge layer includes a first edge layer including an edge line portion and a second edge layer including a surface facing the surface of the cleaning target, wherein the backup layer includes a non-facing surface opposite to the facing surface, wherein degrees of hardness of elastic materials of the first edge layer, the second edge layer, and the backup layer differ from one another, and wherein a film thickness of each of the first edge layer and the second edge layer become gradually thicker in a direction towards the edge line portion.

2. The cleaning blade according to claim 1, wherein a Young's modulus of the elastic material of the first edge layer is higher than the second edge layer and the backup layer.

3. The cleaning blade according to claim 1, wherein a Young's modulus of the elastic material of the first edge layer is higher than the second edge layer, and the Young's modulus of the elastic material of the second edge layer is higher than the backup layer.

4. The cleaning blade according to claim 1, wherein elastic power of a portion near the edge line portion of the first edge layer is 40% or higher.

5. The cleaning blade according to claim 1, wherein, at the edge line portion, a cross-linked structure is formed with an ultraviolet curable resin containing at least an acrylate or methacrylate having a tricyclodecane or adamantane skeleton.

6. The cleaning blade according to claim 5, wherein number of functional groups of the acrylate or methacrylate having the tricyclodecane or adamantane skeleton is one to six.

7. The cleaning blade according to claim 5, wherein the acrylate or methacrylate having the tricyclodecane or adamantane skeleton has a molecular weight of 500 or smaller.

8. The cleaning blade according to claim 5, wherein an acrylate monomer having a molecular weight of 100 to 1500 is mixed with the acrylate or methacrylate having the tricyclodecane or adamantane skeleton.

9. An image forming apparatus, comprising:

an image bearer; and a cleaning member that is in contact with a surface of the image bearer to remove adhering matter adhering to the surface of the image bearer, wherein an image formed on the image bearer is eventually transferred onto a recording medium, and the cleaning blade according to claim 1 is used as the cleaning member.

10. A process cartridge detachably attached to an image forming apparatus, the process cartridge comprising:

an image bearer; and a cleaning member that is in contact with a surface of the image bearer to remove adhering matter adhering to the surface of the image bearer, wherein the cleaning blade according to claim 1 is used as the cleaning member.

* * * * *